US010849473B2

(12) United States Patent
Lim et al.

(10) Patent No.: US 10,849,473 B2
(45) Date of Patent: Dec. 1, 2020

(54) VACUUM CLEANER

(71) Applicant: SAMSUNG ELECTRONICS CO., LTD., Suwon-si (KR)

(72) Inventors: Tae Woon Lim, Suwon-si (KR); Dong Hun Yoo, Suwon-si (KR); Byung Hun Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 198 days.

(21) Appl. No.: 16/064,680

(22) PCT Filed: Jan. 26, 2017

(86) PCT No.: PCT/KR2017/000946
§ 371 (c)(1),
(2) Date: Jun. 21, 2018

(87) PCT Pub. No.: WO2017/131462
PCT Pub. Date: Aug. 3, 2017

(65) Prior Publication Data

US 2019/0000289 A1 Jan. 3, 2019

(30) Foreign Application Priority Data

Jan. 29, 2016 (KR) ..... 10-2016-0011392

(51) Int. Cl.
*A47L 9/04* (2006.01)
*A47L 5/30* (2006.01)
(Continued)

(52) U.S. Cl.
CPC ..... *A47L 9/0488* (2013.01); *A47L 5/30* (2013.01); *A47L 5/36* (2013.01); *A47L 9/00* (2013.01);
(Continued)

(58) Field of Classification Search
CPC ..... A47L 5/30; A47L 5/36; A47L 9/00; A47L 9/04; A47L 9/0455; A47L 9/0477;
(Continued)

(56) References Cited

U.S. PATENT DOCUMENTS

2005/0039282 A1* 2/2005 Paterson ..... A47L 9/0477 15/179
2008/0289138 A1* 11/2008 Yang ..... A47L 9/0422 15/326
(Continued)

FOREIGN PATENT DOCUMENTS

CN 101091631 A 12/2007
CN 102578965 A 7/2012
(Continued)

OTHER PUBLICATIONS

JP-2012143277-A—English Machine Translation (Year: 2012).*
(Continued)

*Primary Examiner* — Marc Carlson
(74) *Attorney, Agent, or Firm* — Staas & Halsey LLP

(57) ABSTRACT

Disclosed is a vacuum cleaner having a structure for preventing foreign matter from entering between a drum brush and a bearing. A vacuum cleaner includes a suction portion formed with a suction port through which air and foreign matter are sucked. The suction portion includes a housing and a drum brush rotatably provided in the housing. The drum brush includes a rotating drum rotating by receiving a driving force and a brush mounted on the rotating drum. The housing is provided with an annular blocking rib, and the brush located at one end of the drum brush is configured to be accommodated in the blocking rib.

15 Claims, 21 Drawing Sheets

(51) Int. Cl.

| | |
|---|---|
| ***B08B 1/00*** | (2006.01) |
| ***A47L 9/00*** | (2006.01) |
| ***A47L 5/36*** | (2006.01) |
| ***A47L 9/22*** | (2006.01) |
| ***A47L 9/16*** | (2006.01) |

(52) U.S. Cl.
CPC ..... *A47L 9/04* (2013.01); *A47L 9/0455* (2013.01); *A47L 9/0477* (2013.01); *A47L 9/16* (2013.01); *A47L 9/22* (2013.01); *B08B 1/00* (2013.01)

(58) Field of Classification Search
CPC . A47L 9/0488; A47L 9/16; A47L 9/22; B08B 1/00
See application file for complete search history.

(56) References Cited

U.S. PATENT DOCUMENTS

| | | | | |
|---|---|---|---|---|
| 2010/0107356 | A1* | 5/2010 | Jakubos | A47L 9/0433 15/383 |
| 2011/0289720 | A1* | 12/2011 | Han | A47L 5/225 15/344 |
| 2013/0276263 | A1* | 10/2013 | Feng | A47L 9/04 15/347 |
| 2017/0143175 | A1* | 5/2017 | Kim | A47L 5/30 |

FOREIGN PATENT DOCUMENTS

| | | | | | |
|---|---|---|---|---|---|
| CN | 102843946 | A | | 12/2012 | |
| JP | 2007-252644 | | | 10/2007 | |
| JP | 2007252644 | A | * | 10/2007 | |
| JP | 2012-143277 | | | 8/2012 | |
| JP | 2012143277 | A | * | 8/2012 | |
| KR | 10-2008-0045410 | | | 5/2008 | |
| KR | 10-2008-0102645 | | | 11/2008 | |
| KR | 10-2010-0088354 | | | 8/2010 | |
| KR | 10-2010-0116860 | | | 11/2010 | |
| KR | 10-2013-0137580 | | | 12/2013 | |
| WO | WO-2011103198 | A1 | * | 8/2011 | A47L 9/0455 |

OTHER PUBLICATIONS

International Search Report dated Apr. 28, 2017 in corresponding International Patent Application No. PCT/KR2017/000946.
Written Opinion of the International Searching Authority dated Apr. 28, 2017 in corresponding International Patent Application No. PCT/KR2017/000946.
Extended European Search Report dated Dec. 4, 2018 from European Patent Application No. 17744583.0, 7 pages.
Chinese Office Action dated Jun. 18, 2020 from Chinese Application No. 201780008685.6, 21 pages.

* cited by examiner

VACUUM CLEANER

CROSS-REFERENCE TO RELATED APPLICATIONS

This application is a National Phase Application under 35 U.S.C. § 371 of PCT International Patent Application No. PCT/KR2017/000946, filed Jan. 26, 2017 which claims the foreign priority benefit under 35 U.S.C. § 119 to Korean Patent Application No. 10-2016-0011392 filed Jan. 29, 2016, the contents of which are incorporated herein by reference.

TECHNICAL FIELD

The present disclosure relates to a vacuum cleaner having an improved structure.

BACKGROUND ART

A vacuum cleaner is a device configured to suck air by a suction force generated by a fan and a motor, and clean by filtering foreign matter contained in the sucked air. The vacuum cleaner sucks air containing foreign matter on a surface to be cleaned, separates and collects the foreign matter from the sucked air, and discharges purified air to the outside of the body of the vacuum cleaner.

The vacuum cleaner may be largely divided into a canister type and an upright type.

The canister type cleaner includes a main body in which a blowing device and a dust collecting device are incorporated, a suction body detached from the main body to suck dust on a surface, and a connection pipe connecting the main body and the suction body. Therefore, a user grasps a handle attached to the connection pipe and cleans while moving the suction body in a direction to clean.

The upright type cleaner includes an upright main body and a suction body integrally coupled to a lower portion of the main body. Therefore, the user grasps the handle provided at an upper side of the main body and cleans while moving the entire upright type cleaner.

In particular, the upright type cleaner mounts a drum brush in the suction body to improve the cleaning efficiency. The drum brush rotates at a high speed and comes into contact with a surface to be cleaned, thereby separating foreign matter adhering to an upper surface of the surface to be cleaned. The separated foreign matter is sucked into the suction body and then introduced into a dust collecting device.

Part of the foreign matter sucked into the suction body at high speed is wound around the drum brush by a rotating force of the rotating drum brush and rotates with the drum brush. This may cause deterioration of the cleaning efficiency. The foreign matter wound around the drum brush may move in a direction of the rotation axis and flow between the drum brush and a bearing connected to an end of the drum brush, thereby hindering the rotation of the drum brush.

DISCLOSURE

Technical Problem

It is an aspect of the present disclosure to provide a vacuum cleaner having a structure for preventing foreign matter from entering between a drum brush and a bearing.

Technical Solution

In accordance with an aspect of the present disclosure, a vacuum cleaner includes a suction portion formed with a suction port through which air and foreign matter are sucked. The suction portion includes a housing and a drum brush rotatably provided in the housing and the drum brush includes a rotating drum rotating by receiving a driving force and a brush mounted on the rotating drum, and the housing is provided with an annular blocking rib, and the brush located at one end of the drum brush is configured to be accommodated in the blocking rib.

The brush accommodated in the blocking rib may be configured to contact an inner wall of the blocking rib.

The brush may include a first brush configured to pick up foreign matter and a second brush provided to be shorter than the first brush and be accommodated in the blocking rib.

The brush may extend spirally along a longitudinal direction of the rotating drum.

The second brush may be configured to surround a part of an outer surface of one end of the rotating drum.

The suction portion may include a driving source, and the driving source may be connected to the other end of the drum brush to provide a driving force to the drum brush.

A connecting member to which one end of the drum brush unit may be connected is mounted on the housing.

A mounting hole may be provided on one side of the housing, and the connecting member and the drum brush may be connected through the mounting hole.

The connecting member may be detachably mounted on the housing together with the drum brush unit.

The drum brush unit may be detached from the housing or mounted on the housing by passing through the mounting hole.

A remover protrusion protruding inward may be provided on an outer circumferential surface of the mounting hole, and when the drum brush unit passes through the mounting hole, foreign matter attached to the outer circumferential surface of the drum brush unit may be separated by the remover protrusion.

The suction portion may be provided with a wheel for movement.

The vacuum cleaner may further include a main body connected to the suction portion, and a frame on which the main body and the suction portion are mounted.

The main body may be configured to be detachably mounted on the frame.

The main body may be configured to be detachable from the frame to operate as a separate vacuum cleaner.

In accordance with another aspect of the present disclosure, a vacuum cleaner includes a main body including a fan motor and a dust collecting device, a suction portion connected to the main body to clean a surface, and a drum brush rotatably mounted on the suction portion. An annular blocking rib configured to surround one side of the drum brush is provided on one side of the suction portion, and a portion of the drum brush is configured to rotate in the blocking rib to prevent foreign matter from entering the blocking rib.

The drum brush may include a rotating drum rotating about a rotary shaft and a brush provided on an outer circumferential surface of the rotating drum, and a diameter of the blocking rib may be configured to be larger than a diameter of the rotating drum.

A portion of the brush may be configured to contact the blocking rib.

The brush may include a first brush configured to pick up foreign matter while rotating, and a second brush provided at one end of the rotating drum and accommodated in the blocking rib to prevent the entry of foreign matter.

A length of the second brush may be configured to be shorter than a length of the first brush.

Advantageous Effects

In accordance with an aspect of the present disclosure, it may be possible to prevent foreign matter from entering between a bearing and a drum brush in which the bearing is connected to an end of the drum brush, thereby preventing the rotation of the drum brush from being disturbed by the foreign matter.

MODE FOR INVENTION

Hereinafter, a vacuum cleaner according to an embodiment will be described in detail with reference to the drawings.

Figure 1:
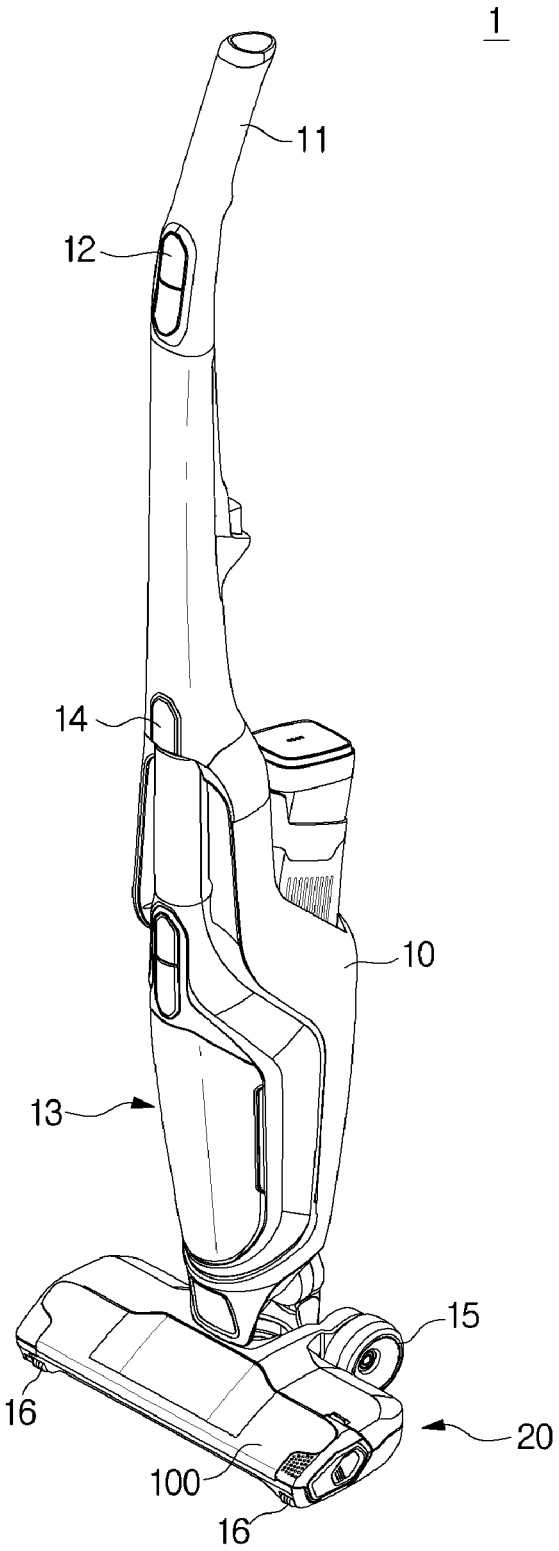
FIG. 1 is a perspective view illustrating a vacuum cleaner according to an embodiment.
Figure 2:
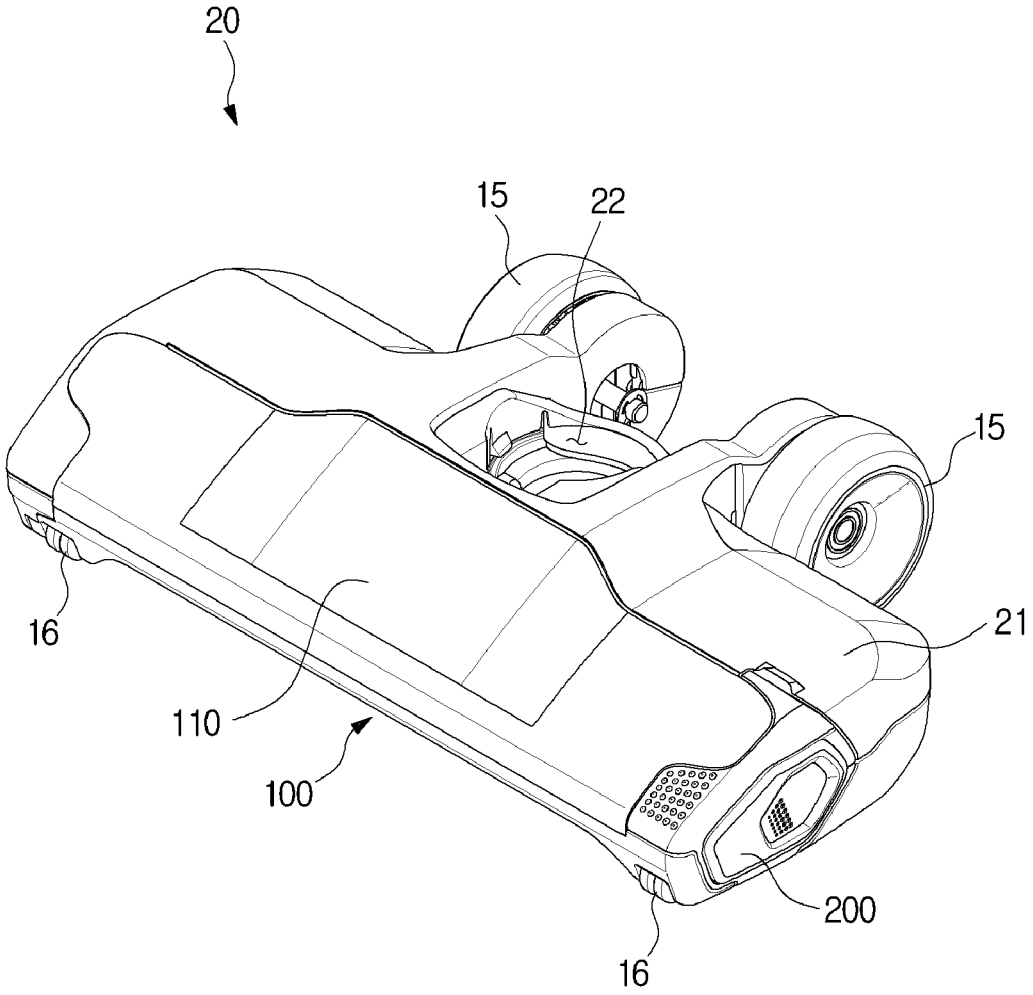
FIG. 2 is a perspective view illustrating a suction portion of a vacuum cleaner according to an embodiment.
Figure 3:
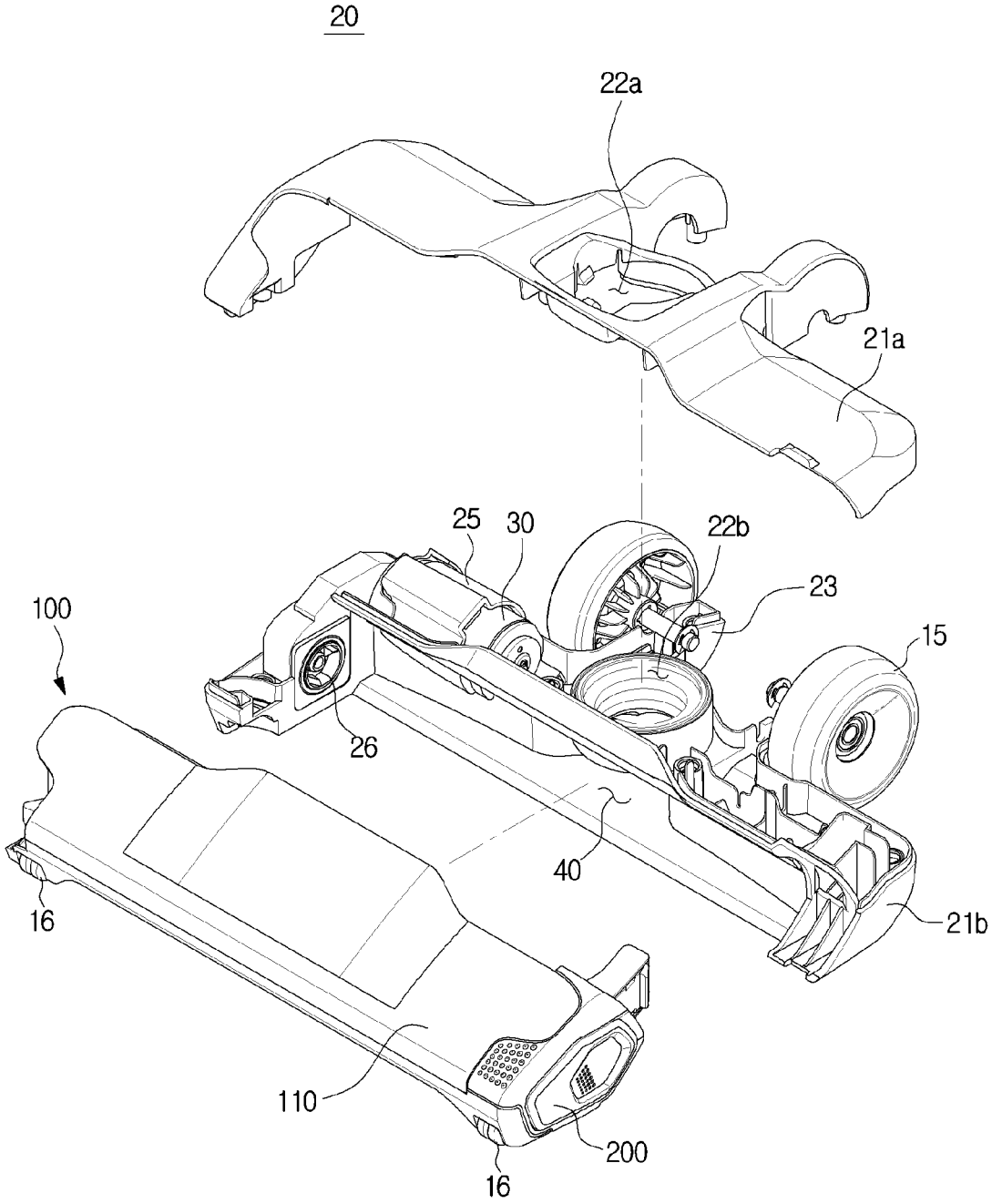
FIG. 3 is an exploded perspective view illustrating a suction portion according to an embodiment.

FIG. 1 is a perspective view illustrating a vacuum cleaner according to an embodiment. FIG. 2 is a perspective view illustrating a suction portion of a vacuum cleaner according to an embodiment. FIG. 3 is an exploded perspective view illustrating a suction portion according to an embodiment.

Referring to FIGS. 1 to 3, a vacuum cleaner 1 according to an embodiment may be provided in an upright type. Alternatively, the vacuum cleaner 1 according to an embodiment may be a stick-type vacuum cleaner in which a main body 13 is detachably mounted on a frame 10.

The vacuum cleaner 1 may include the frame 10 and the main body 13 detachably mounted on the frame 10. The main body 13 includes a fan motor configured to generate a suction force and a cyclone dust collector configured to separate and collect foreign matter in the air. A user may use the main body 13 in a state where the main body 13 is mounted on the frame 10 or use the main body 13 separated from the frame 10 according to the ease of use.

For example, when cleaning a surface of a room, the main body 13 may be mounted on the frame 10. When cleaning a shelf or an interior of an automobile, the main body 13 may be separated from the frame 10.

At one end of the frame 10, a suction portion 20 may be provided. When the fan motor provided in the main body 13 is operated, air and foreign matter may be sucked together through the suction portion 20. The foreign matter in the sucked air may be separated and collected in the cyclone dust collector.

The main body 13 may be detachably attached to the frame 10. The frame 10 may be provided with a pressing button 14 for separating the main body 13. The main body 13 may be detached from the frame 10 by pressing the pressing button 14 while the main body 13 is mounted on the frame 10.

The main body 13 may be provided with a suction passage (not shown) connected to the suction portion 20. The suction passage of the main body 13 and the suction portion 20 may be connected directly without a separate connecting member.

On an upper side of the frame 10, a handle 11 may be provided so that the user operates it. The handle 11 may be provided with a switch 12 for controlling an operation of the fan motor.

Wheels 15 and 16 may be provided at a bottom surface of the suction portion 20. The vacuum cleaner 1 may be moved on a surface by the wheels 15 and 16. The wheels 15 and 16 may include the first wheel 15 provided at the rear of the suction portion 20 and the second wheel 16 provided at the front of the suction portion 20. The wheels 15 and 16 are provided at the front and rear of the suction portion 20, respectively, so that the vacuum cleaner 1 is stably supported. The user may clean the surface while holding the handle 11 and moving the vacuum cleaner 1

The suction portion 20 may be connected to a lower end of the main body 13. The suction portion 20 includes a case 21 which forms an appearance of the suction portion 20. An inlet port 22 is formed in the case 21 so as to link the inlet port 22 and the suction passage provided in the main body 13.

The suction portion 20 may be provided with a drum brush unit 100. The drum brush unit 100 may include a housing 110 forming an appearance and a drum brush 140 (see FIG. 5), which will be described later. The drum brush unit 100 may be detachably mounted on the suction portion 20.

The drum brush unit 100 may have a suction port 40 through which air and foreign matter are sucked. The suction port 40 and the inlet port 22 may be connected to each other to form one flow path. The air and foreign matter sucked through the suction port 40 may be introduced into the cyclone dust collector of the main body 13 through the inlet port 22.

The case 21 may include an upper case 21*a* forming an upper outer appearance of the suction portion 20 and a lower case 21*b* forming a lower appearance of the suction portion 20. A first inlet port 22*a* may be formed in the upper case 21*a* and a second inlet port 22*b* may be formed in the lower case 21*b* to correspond to the first inlet port 22*a*. When the upper case 21*a* and the lower case 21*b* are coupled to each other, the first inlet port 22*a* and the second inlet port 22*b* may form one inlet port 22.

A driving source mounting portion 25 may be provided on one side of the lower case 21*b* to mount a driving source 30 thereon. The driving source 30 may transmit a driving force to rotate the drum brush 140, which will be described later. A drum brush mounting portion 26 on which the drum brush 140 is mounted may be provided on one side of the lower case 21*b*.

A connecting member mounting portion 272 for mounting a connecting member 200 connected to the drum brush 140 may be provided on the other side of the lower case 21*b*. The connecting member 200 may be connected to the drum brush 140.

A wheel mounting portion 23 to which the wheel 15 is mounted may be provided at the rear of the lower case 21*b*. The wheel 15 may be rotatably mounted on the wheel mounting portion 23.

Figure 4:
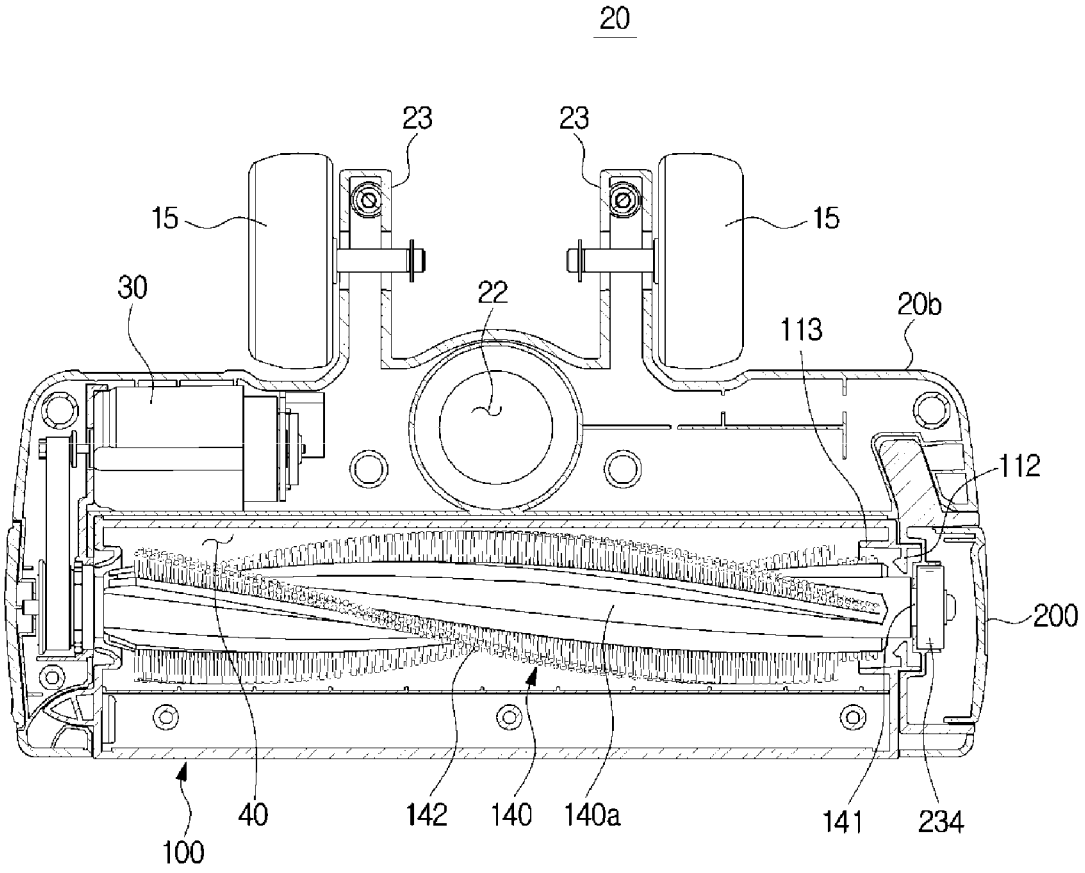
FIG. 4 is a bottom view illustrating a suction portion according to an embodiment.
Figure 5:
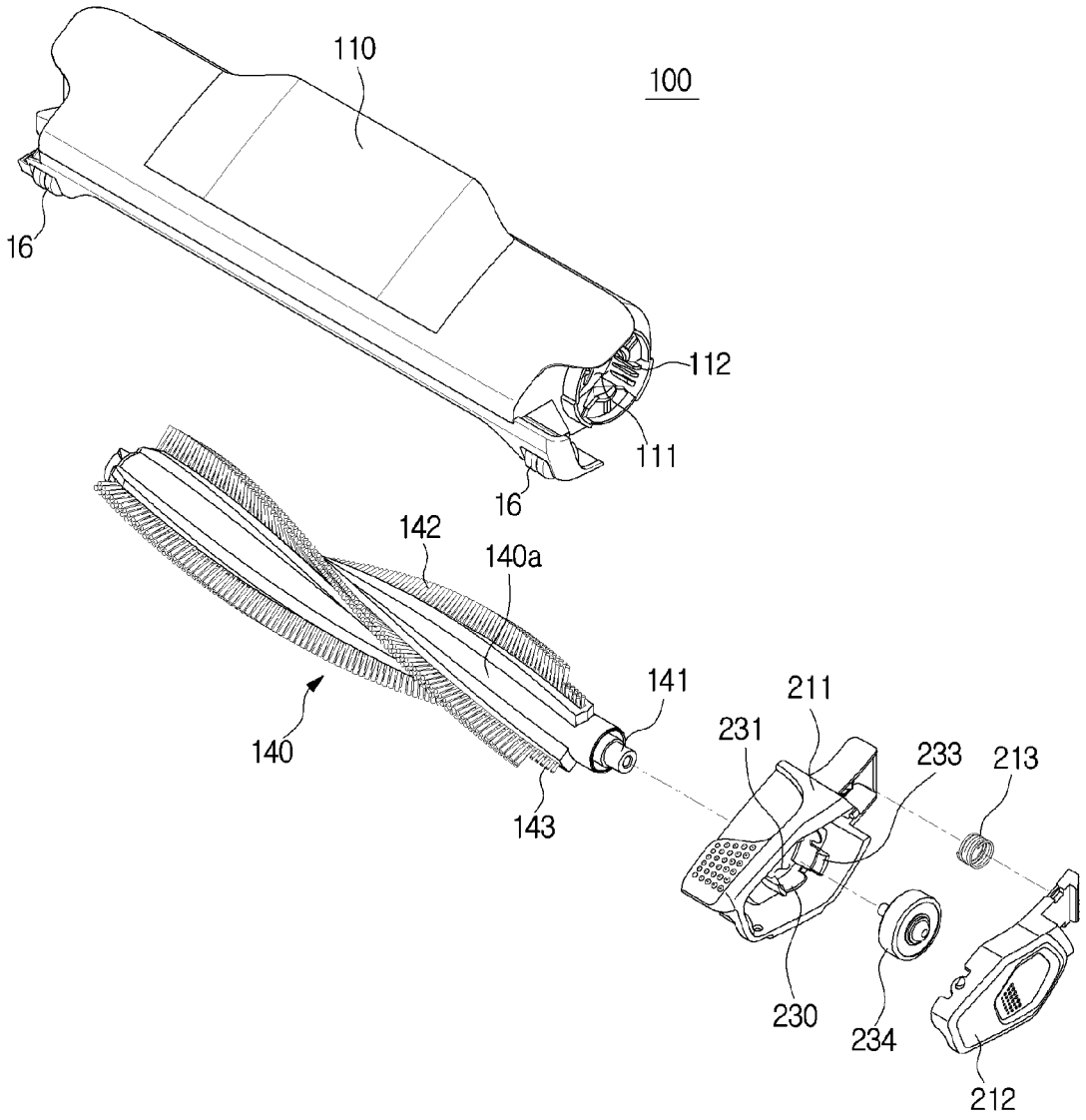
FIGS. 5 and 6 are exploded perspective views illustrating a drum brush unit according to an embodiment.
Figure 6:
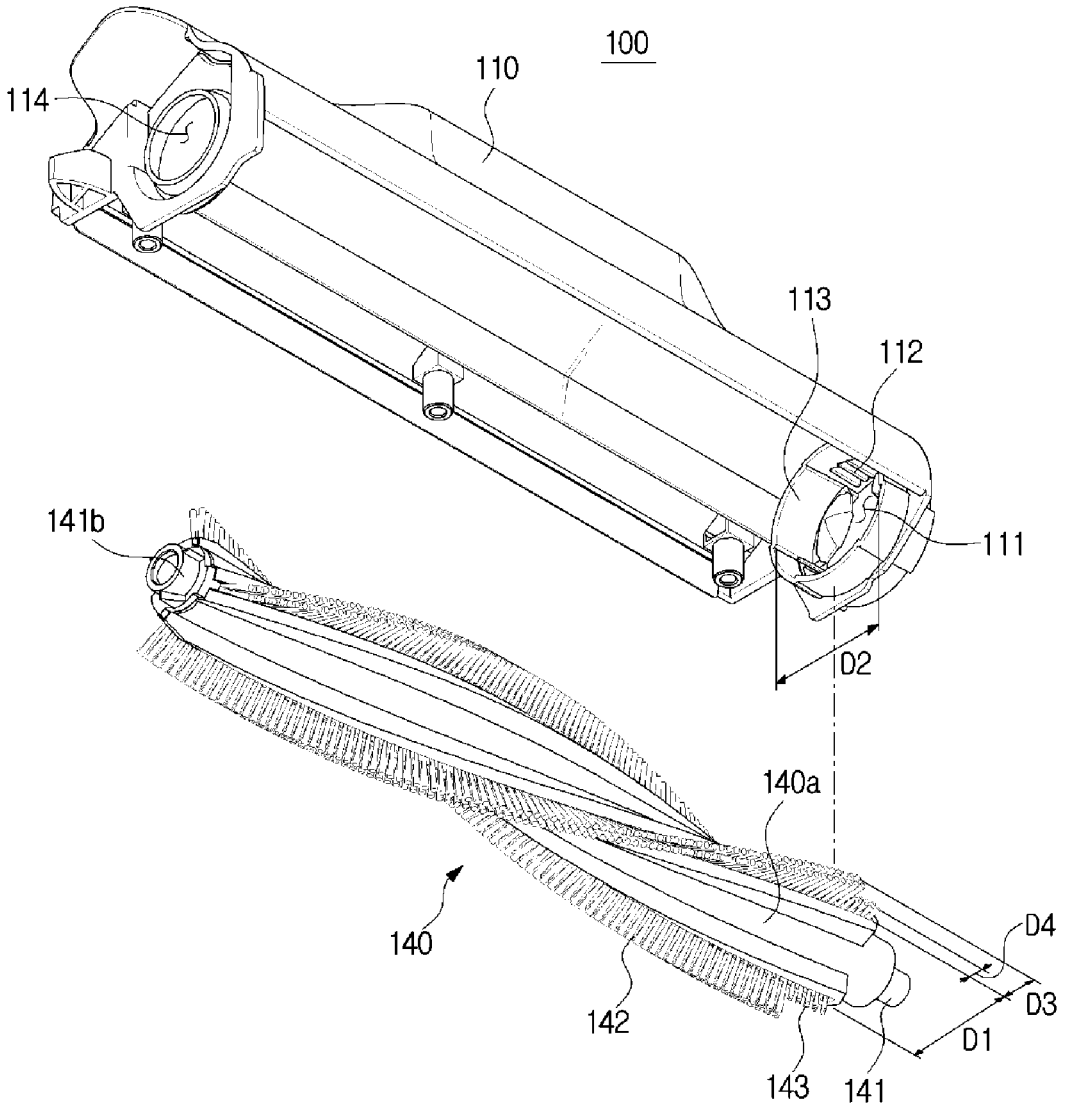
Figure 7:
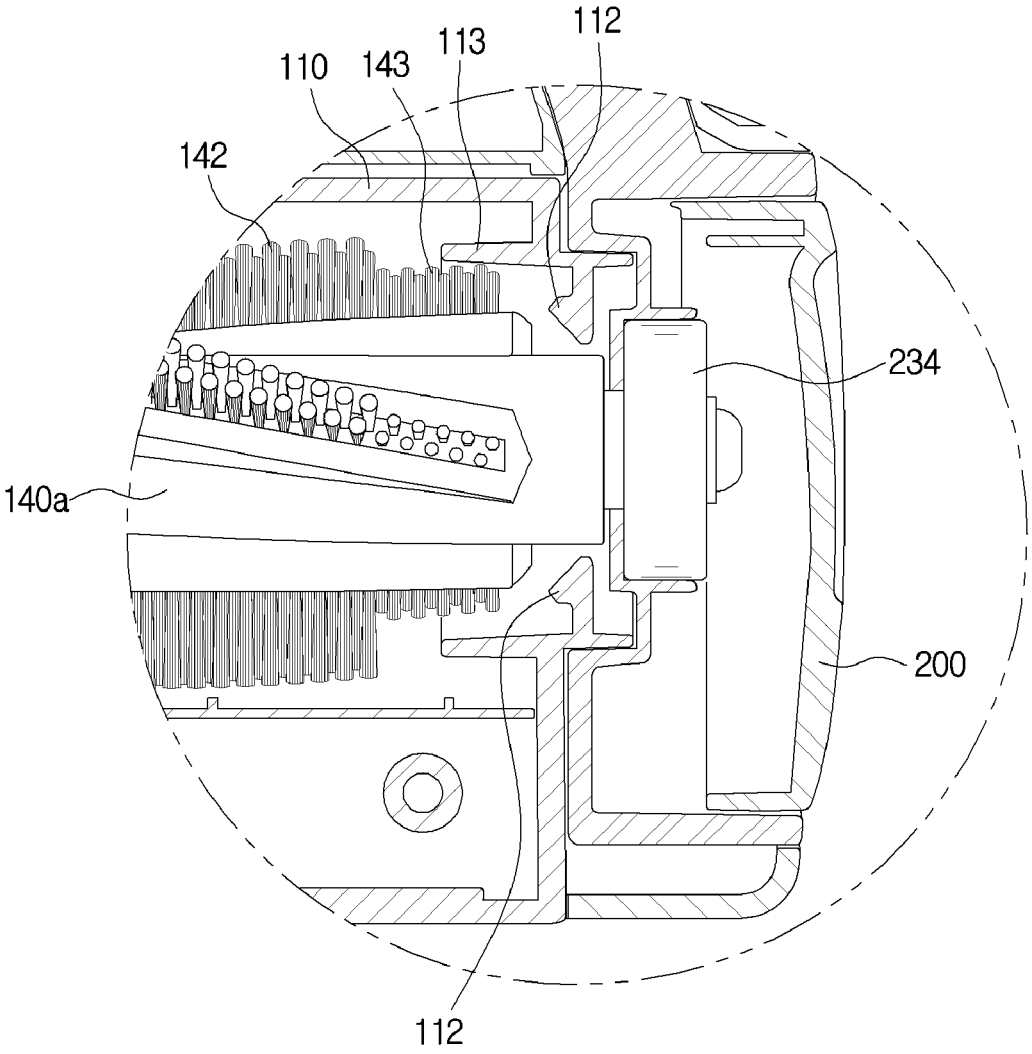
FIGS. 7 and 8 are sectional views illustrating a part of a drum brush unit according to an embodiment.
Figure 8:
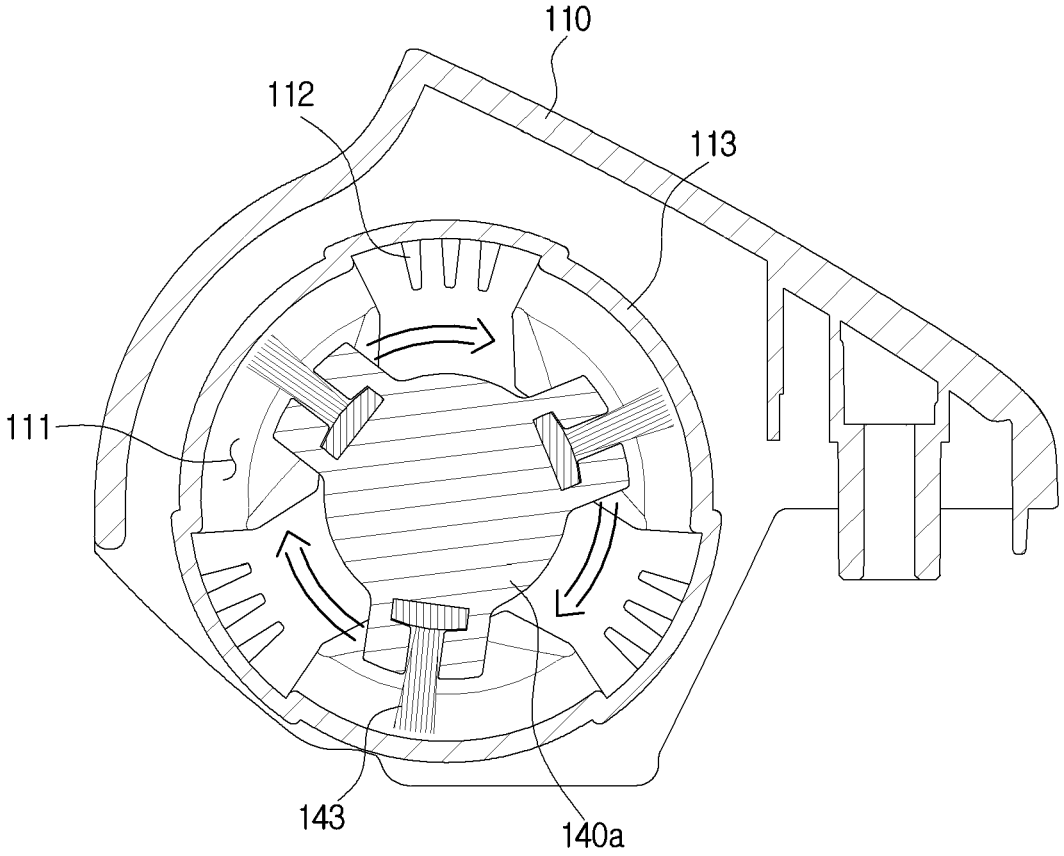

FIG. 4 is a bottom view illustrating a suction portion according to an embodiment. FIGS. 5 and 6 are exploded perspective views illustrating a drum brush unit according to an embodiment. FIGS. 7 and 8 are sectional views illustrating a part of a drum brush unit according to an embodiment.

Referring to FIGS. 4 to 8, the drum brush 140 may be rotatably mounted on the suction portion 20 according to an embodiment. The drum brush unit 100 may be detachably mounted on the suction portion 20 and the drum brush 140 may be mounted on the drum brush unit 100.

The drum brush unit 100 may include the housing 110 forming an outer appearance and the drum brush 140 accommodated in the housing 110. The drum brush 140 may be rotatably installed in the housing 110. The suction port 40 may be formed in the housing 110 to suck foreign matter on the surface. The suction port 40 may be connected to the inlet port 22 of the suction portion 20.

The drum brush 140 may receive the driving force from the driving source 30 and rotate. The drum brush 140 may be provided at the suction port 40 side. The drum brush 140 may pick up foreign matter on the surface while rotating. The picked up foreign matter is sucked by the suction force of the fan motor and may be moved to the cyclone dust collector provided in the main body 13 through the suction port 40 and the inlet port 22. The cyclone dust collector may separate and collect the foreign matter from the sucked air by using swirling air flow.

The drum brush 140 may include a cylindrical rotating drum 140*a* and a first brush 142 provided at the outer peripheral surface of the rotating drum 140*a*. The brush 142 may be provided to extend spirally along a longitudinal direction of the rotating drum 140*a*. When the drum brush 140 rotates, the foreign matter on the surface is picked up by the brush 142, and may be sucked into the suction port 40 by the suction force of the fan motor. In the case of a surface having unevenness such as a carpet, foreign matter is effectively picked up by the brush 142, and the surface can be cleaned.

One side of the drum brush 140 may be mounted on the drum brush mounting portion 26 of the lower case 21*b* and the other side of the drum brush 140 may be mounted on the connecting member 200. The drum brush 140 may receive the driving force from the driving source 30 and rotate. The structure in which the driving force is transmitted from the driving source 30 to the drum brush 140 may be realized by a gear connecting structure, a coupling structure of a pulley and a belt, and the like.

Rotary shafts 141*a* and 141*b* may protrude from both ends of the drum brush 140. The first rotary shaft 141*b* provided on one side of the drum brush 140 may be mounted to the drum brush mounting portion 26 provided in the lower case 21*b*. The drum brush 140 may rotate by receiving the driving force from the driving source 30 through the first rotary shaft 141*b*.

The second rotary shaft 141*a* provided on the other side of the drum brush 140 may be mounted on the connecting member 200. The connecting member 200 may be provided with a bearing 234 and the second rotary shaft 141*a* may be rotatably mounted to the connecting member 200 through the bearing 234.

The housing 110 may be provided with mounting holes 111 and 114 so that the rotary shafts 141*a* and 141*b* of the drum brush 140 are connected to the lower case 21*b* and the connecting member 200, respectively. The rotary shafts 141*a* and 141*b* may be mounted on the lower case 21*b* and the connecting member 200 located outside the housing 110 by passing through the mounting holes 111 and 114 formed in the housing 110, respectively.

The mounting hole 111 positioned adjacent to the connecting member 200 may be provided so that the drum brush 140 passes through the mounting hole 111. A diameter of the mounting hole 111 may be larger than a diameter of the drum brush 140 or equal to the diameter of the drum brush 140. The diameter of the mounting hole 111 may be set to be larger than a diameter of the cylindrical rotating drum 140*a* to be described later. The diameter of the mounting hole 111 may be set to be smaller than the entire diameter including the brush 142 provided on an outer circumferential surface of the rotating drum 140*a*.

An annular blocking rib 113 may be provided outside the mounting hole 111. The blocking rib 113 may be integrally formed with the housing 110. The blocking ribs 113 may protrude toward the inside of the housing 110 where the drum brush 140 is located. A diameter D2 of the blocking rib 113 may be larger than a diameter D1 of the rotating drum 140*a* of the drum brush 140.

The first brush 142 extending spirally may be provided on an outer peripheral surface of the drum brush 140. A second brush 143 may be provided at the other end of the drum brush 140. A length D4 of the second brush 143 protruding from the rotating drum 140*a* may be shorter than a length D3 of the first brush 142 protruding from the rotating drum 140*a*. The second brush 143 may be formed to be part of a spiral shape together with the first brush 142.

The blocking rib 113 may be provided to surround part of the drum brush 140 where the second brush 143 is located. The diameter D2 of the blocking rib 113 may be equal to or slightly smaller than the diameter of the drum brush 140 where the second brush 143 is located. In this case, the diameter of the drum brush 140 refers to the diameter of the entire drum brush 140 including the rotating drum 140*a* and the first brush 142.

When the drum brush 140 rotates, the second brush 143 may rotate in contact with an inner wall of the blocking rib 113. The second brush 143 is provided to rotate in contact with the inner wall of the blocking rib 113 to prevent foreign matter from entering between the second brush 143 and the blocking rib 113.

Although the second brush 143 is described as being in contact with the inner wall of the blocking rib 113 in the above description, the second brush 143 may not be in contact with the inner wall of the blocking rib 113. The distance between the end of the second brush 143 and the inner wall of the blocking rib 113 may be finely adjusted to prevent foreign matter from entering between the second brush 143 and the blocking rib 113.

The first brush 142 having a longer length than the second brush 143 may be positioned outside the blocking rib 113. When the drum brush 140 rotates in the housing 110, the first brush 142 having a longer length than the second brush 143 picks up foreign matter on the surface.

A remover protrusion 112 protruding inward may be provided on an outer circumferential surface of the mounting hole 111 in which the connecting member 200 is mounted. When the drum brush 140 passes through the mounting hole 114, foreign matter such as hair attached to the drum brush 140 may be separated from the drum brush 140 by the remover protrusion 112.

The connecting member 200 may include a first case 211 and a second case 212 mounted to the first case 211. The bearing 234 to which the second rotary shaft 141*a* of the drum brush 140 is connected may be accommodated between the first case 211 and the second case 212.

An elastic member 213 may be provided between the first case 211 and the second case 212. The second case 212 may be resiliently supported with respect to the first case 211 by the elastic member 213. The user may press the second case 212 to separate the connecting member 200 from the suction portion 20. When a pressing state of the second case 212 is released, it is possible to return to an original state before the second case 212 is pressed by the elastic member 213. A conventional configuration may be applied to a configuration in which the connecting member 200 is separated from the suction portion 20 by being pressed to the second case 212, and therefore, a detailed description thereof will be omitted.

The first case 211 may be mounted on the connecting member mounting portion 272 provided in the lower case 21*b*. The first case 211 may have a through hole 231 through which the second rotary shaft 141*a* of the drum brush 140 passes.

A supporting portion 230 may protrude from a periphery of the through hole 231. The supporting portion 230 may protrude inward of the connecting member 200, that is, from one surface of the first case 211 toward the second case 212 side. The bearing 234 may be positioned between the through hole 231 and the supporting portion 230. The bearing 234 may be connected to the second rotary shaft 141*a* through the through hole 231. At least one supporting protrusion 233 protruding from the periphery of the through hole 231 may be formed to prevent the bearing 234 from coming off.

When the drum brush 140 receives the driving force from the driving source 30 and rotates, foreign matter on the surface may be picked up by the first brush 142. Generally, the picked up foreign matter is sucked into the suction port 40 by the suction force of the fan motor. Occasionally, the picked up foreign matter may be attached to the first brush 142 and may move to the right and left sides along a longitudinal direction of the first brush 142 in accordance with the rotation of the drum brush 140.

The foreign matter moved in the longitudinal direction of the first brush 142 may be moved toward the rotary shafts 141*a* and 141*b* of the drum brush 140 and may be introduced between the rotary shafts 141*a* and 141*b* and the connecting portions to which the rotating shafts 141*a* and 141*b* are coupled. The foreign matter moved toward the rotary shafts 141*a* and 141*b* of the drum brush 140 may flow into the spaces between the rotary shafts 141*a* and 141*b* of the drum brush 140, the connecting member 200 to which the rotary shafts 141*a* and 141*b* are coupled, and the drum brush mounting portion 26 of the lower case 21*b*. The foreign matter may interfere with the rotation of the drum brush 140.

However, since the second brush 143 rotates together with the drum brush 140 in a state of being in contact with the inner wall of the blocking rib 113 to form a blocking structure, the foreign matter picked up by the first brush 142 is blocked by the second brush 143 and the blocking rib 113 and may not move toward the rotary shaft 141*a*. The foreign matter attached to the first brush 142 may not move toward the rotary shaft 141*a* of the drum brush 140 due to this blocking structure, and thus the drum brush 104 may smoothly rotate without being disturbed by the foreign matter.

In the above description, a blocking structure by the second rotary shaft 141*a* and the second brush 143 provided on the other side of the drum brush 140 has been described. However, a blocking structure may be similarly provided at the first rotary shaft 141*b* provided on one side of the drum brush 140.

The mounting hole 111 provided on the other side of the drum brush 140 is configured to have a large diameter so that the drum brush 140 passes through the mounting hole 111. Therefore, the foreign matter may move toward the rotary shaft 141 through an empty space between the drum brush 140 and an inner wall of the housing 110 forming the mounting hole 111. If foreign matter is introduced between the rotary shaft 141 and the connecting member 200, the rotation of the drum brush 140 may be disturbed. The user needs to detach the drum brush 140 to remove the foreign matter between the rotary shaft 141*a* and the connecting member 200.

Conventionally, there has been a disadvantage in use because a structure in which the foreign matter is prevented from moving toward the rotary shaft side, thereby preventing the foreign matter from interfering with the rotation of the drum brush was not provided. Since the rotation of the drum brush is disturbed, the foreign matter on a surface such as carpet may not be easily picked up and the cleaning is not smoothly performed. In this case, the user needs to frequently clean the drum brush.

However, in the case of the present disclosure, the foreign matter picked up by the drum brush 140 is prevented from entering between the rotary shaft 141*a* and the connecting portion thereof, thereby the rotation of the drum brush 140 and the cleaning is smoothly performed. In addition, since the number of times of separating and cleaning the drum brush by the user to remove the foreign matter is decreased, the ease of use may be improved.

It is not necessary to provide a separate member for blocking foreign matter from flowing into the rotary shaft side, thus that the manufacturing costs may be prevented from increasing. The foreign matter blocking structure is easily implemented by the blocking rib 113 provided integrally with the housing 110 and the brush 143 provided to rotate within the blocking rib 113.

Figure 9:
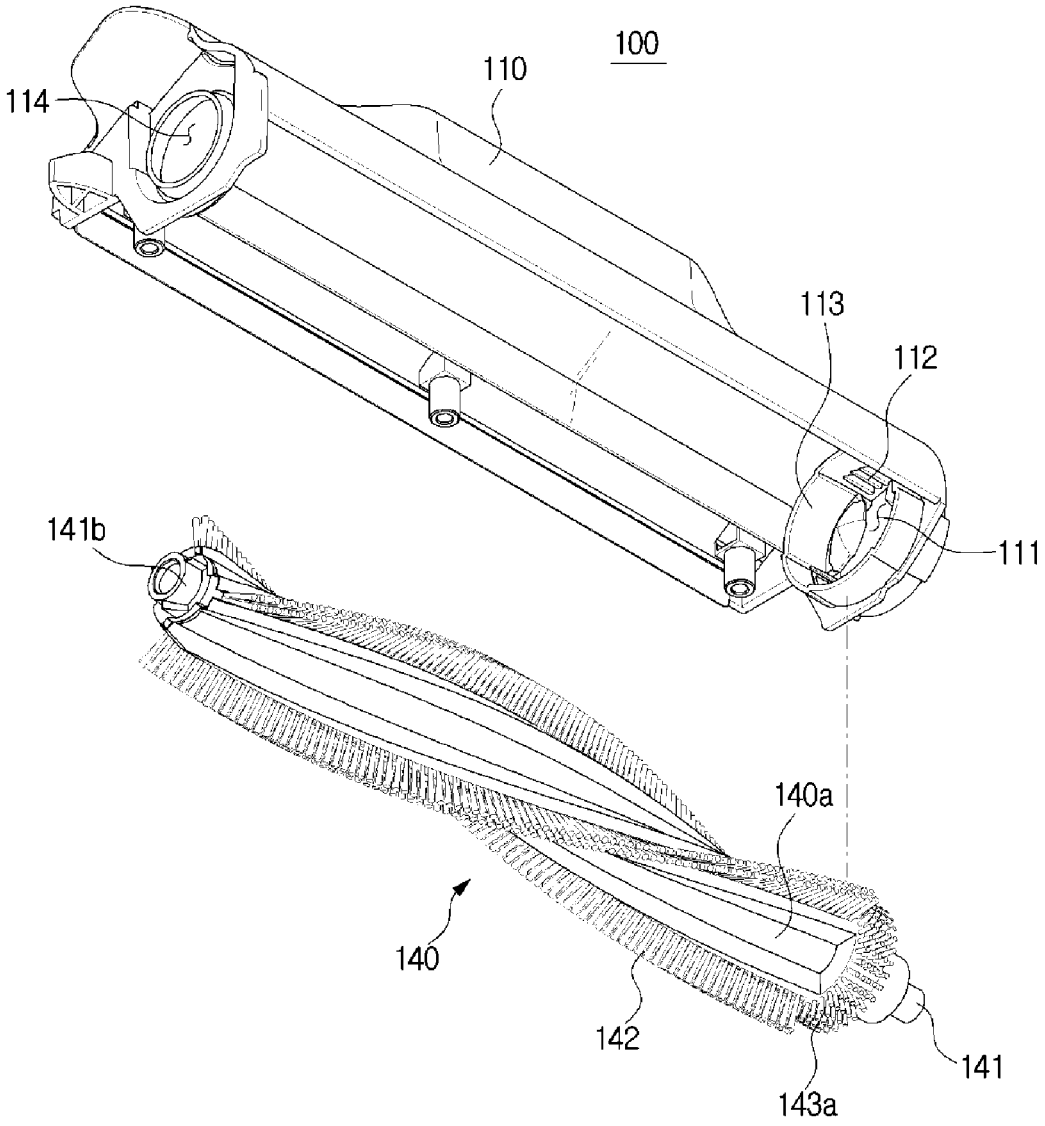
FIG. 9 is a bottom view illustrating a drum brush unit according to another embodiment.
Figure 10:
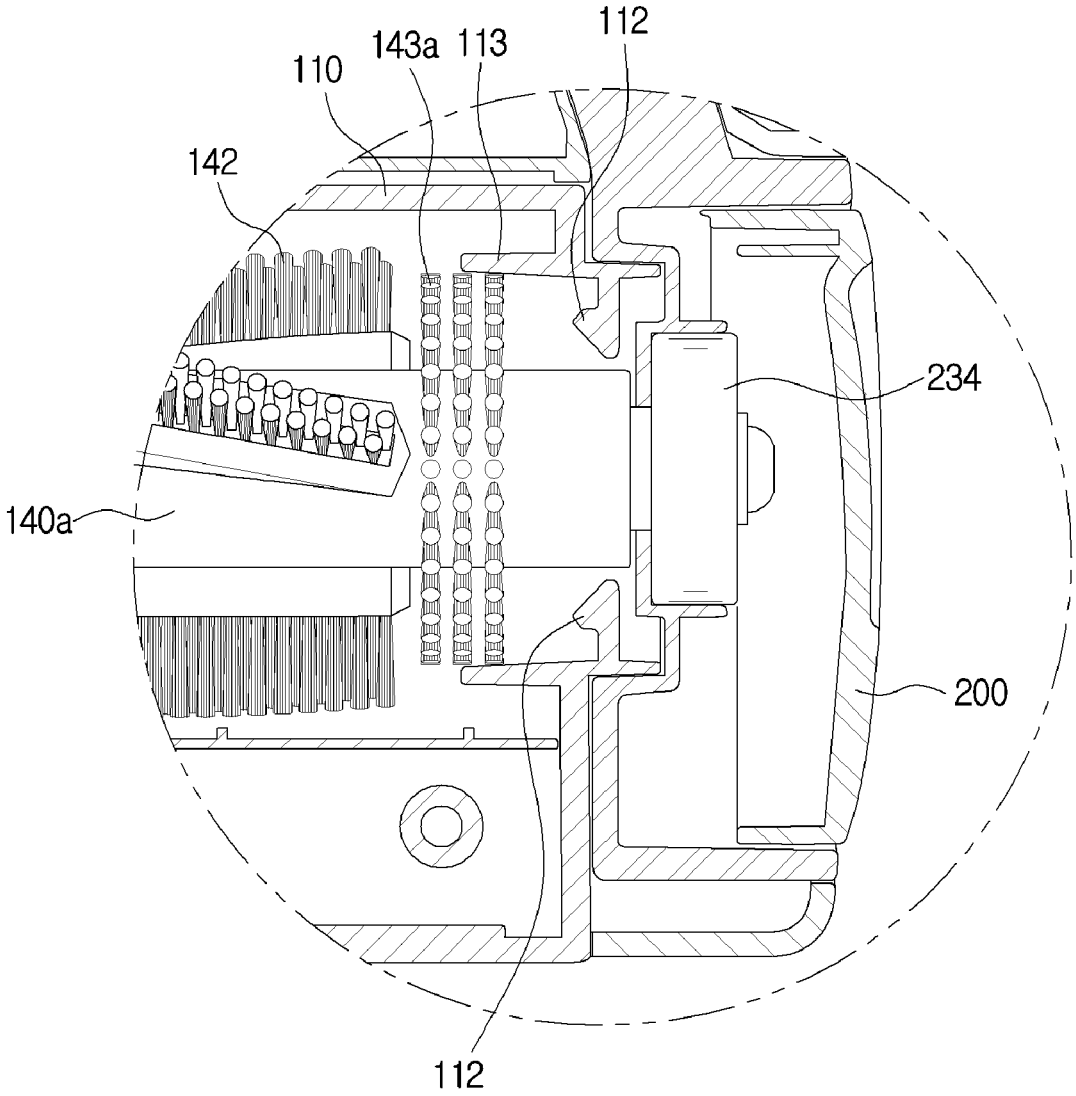
FIG. 10 is a sectional view illustrating a part of the drum brush unit shown in FIG. 9.

FIG. 9 is a bottom view illustrating a drum brush unit according to another embodiment. FIG. 10 is a sectional view illustrating a part of the drum brush unit shown in FIG. 9.

Referring to FIG. 9, a drum brush unit according to another embodiment is shown. A structural feature where the housing 110 forms an appearance of the drum brush unit, and the drum brush 140 is accommodated in the housing 110 is similar to the drum brush unit shown in FIGS. 4 to 8.

In the case of the drum brush 140 shown in FIG. 9, a second brush 143*a* provided on an outer surface of the rotating drum 140*a* is provided to cover part of the outer surface of the rotary drum 140*a* entirely. In the drum brush unit shown in FIGS. 4 to 8, the second brush 143 has a spiral shape together with the first brush 142, and is shorter than the first brush 142. However, in the case of the drum brush unit according to another embodiment shown in FIG. 9, the second brush 143*a* does not have the same spiral shape as the first brush 142 and is provided to surround part of the outer surface of the rotating drum 140*a*.

As shown in FIG. 10, the second brush 143*a* may be provided so as to rotate in contact with an inner surface of the blocking rib 113 provided in the housing 110. When the drum brush unit rotates, the foreign matter on the surface is picked up by the first brush 142, and the foreign matter may be prevented from entering between the second brush 143*a* and the blocking rib 113. Since the blocking structure prevents the foreign matter from flowing into the rotary shaft and its connecting portion, the drum brush unit may rotate smoothly, and the user does not need to separate the drum brush unit and remove the foreign matter.

Figure 11:
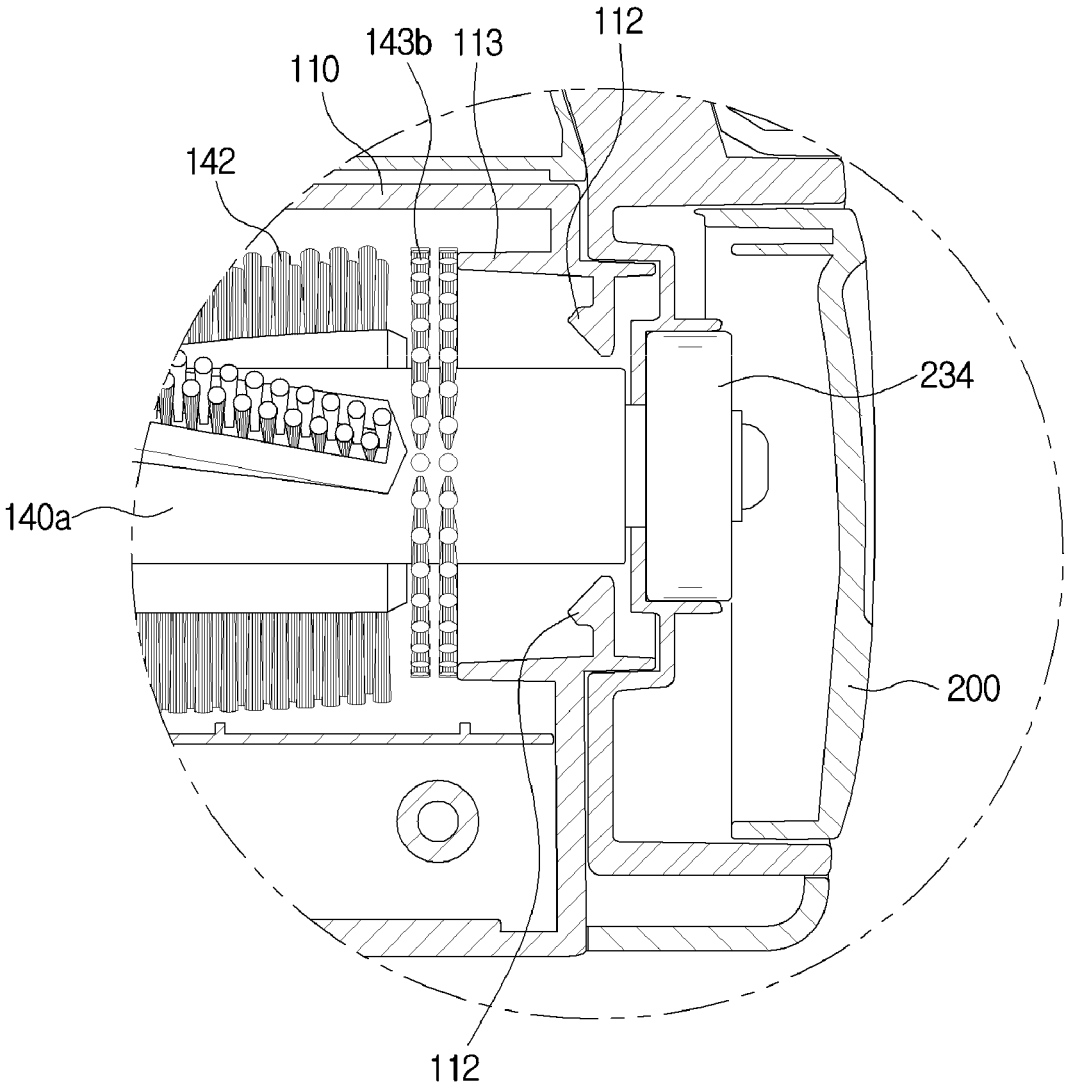
FIG. 11 is a cross-sectional view illustrating a part of a drum brush unit according to another embodiment of the present disclosure.

FIG. 11 is a cross-sectional view illustrating a part of a drum brush unit according to another embodiment of the present disclosure.

As shown in FIGS. 9 and 10, the second brush 143*a* according to the present embodiment may be formed so as not to have the same spiral shape as the first brush 142 and to surround part of the outer periphery of the rotating drum 140*a*.

However, according to the present embodiment, a length of a second brush 143*b* may be longer than a length of the first brush 142. The second brush 143*b* may not be accommodated inside the blocking rib 113. The second brush 143*b* may contact the side surface of the blocking rib 113. Accordingly, the second brush 143*b* can block foreign matter from flowing into an inner side of the blocking rib 113.

Figure 12:
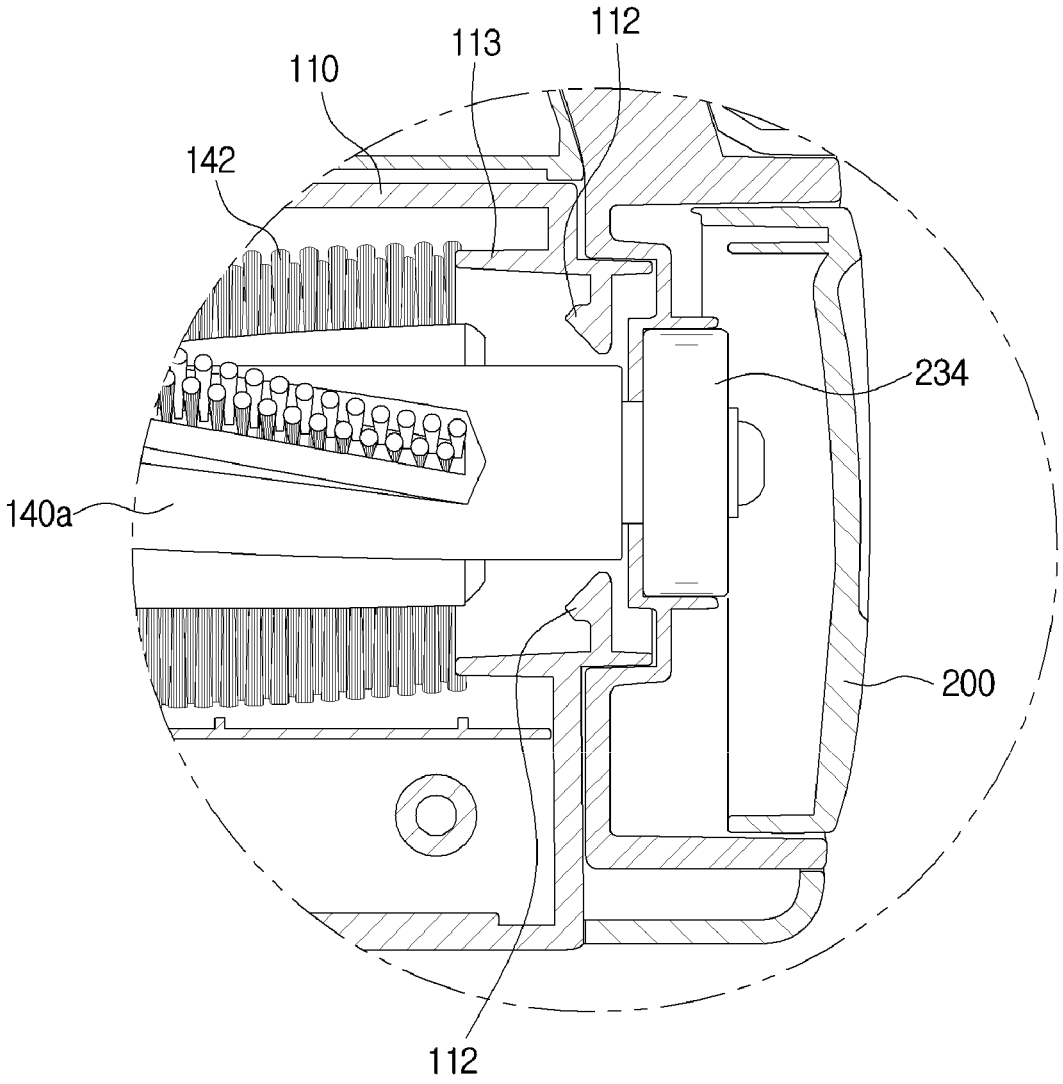
FIG. 12 is a cross-sectional view illustrating a part of a drum brush unit according to another embodiment of the present disclosure.

FIG. 12 is a cross-sectional view illustrating a part of a drum brush unit according to another embodiment of the present disclosure.

According to the present embodiment, a separate second brush may not be provided. The brush 142 may be provided to have a predetermined length. The brush 142 may extend spirally along a longitudinal direction of the rotating drum 140*a*.

The brush 142 may contact the side surface of the blocking rib 113. Accordingly, the brush 142 may block foreign matter from flowing into the blocking rib 113.

Figure 13:
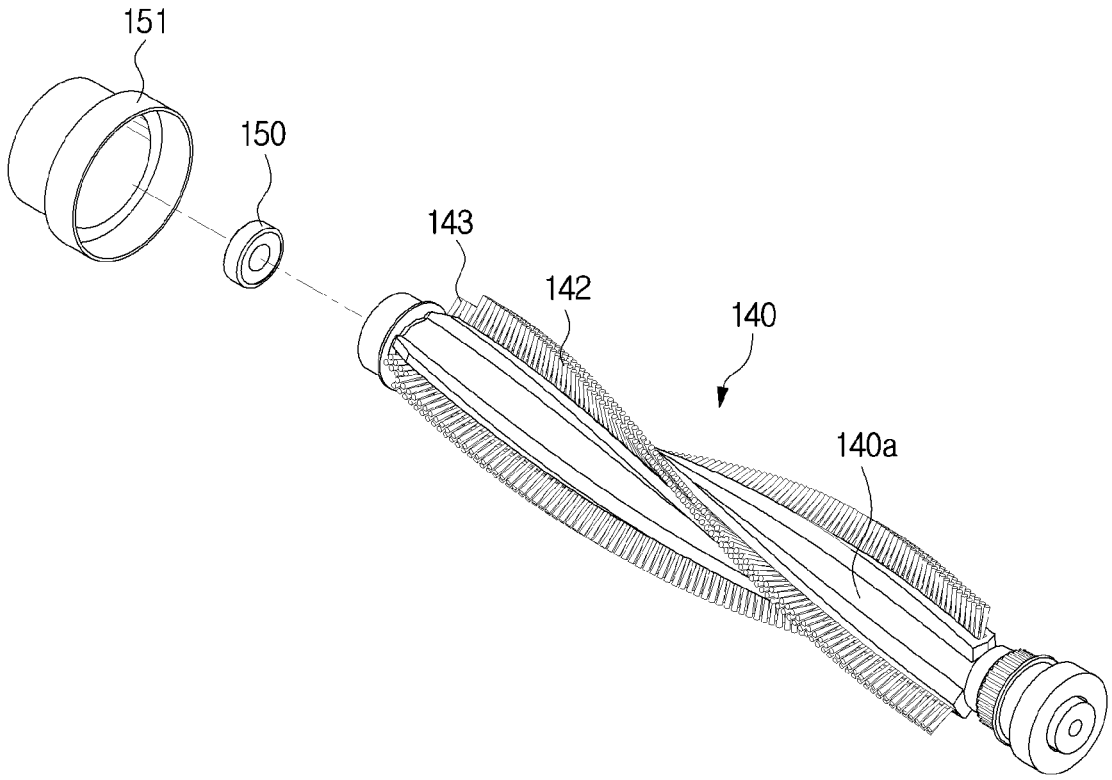
FIG. 13 is a view illustrating a drum brush, a rotating drum bearing, and a rotating drum cover in a vacuum cleaner according to another embodiment of the present disclosure.
Figure 14:
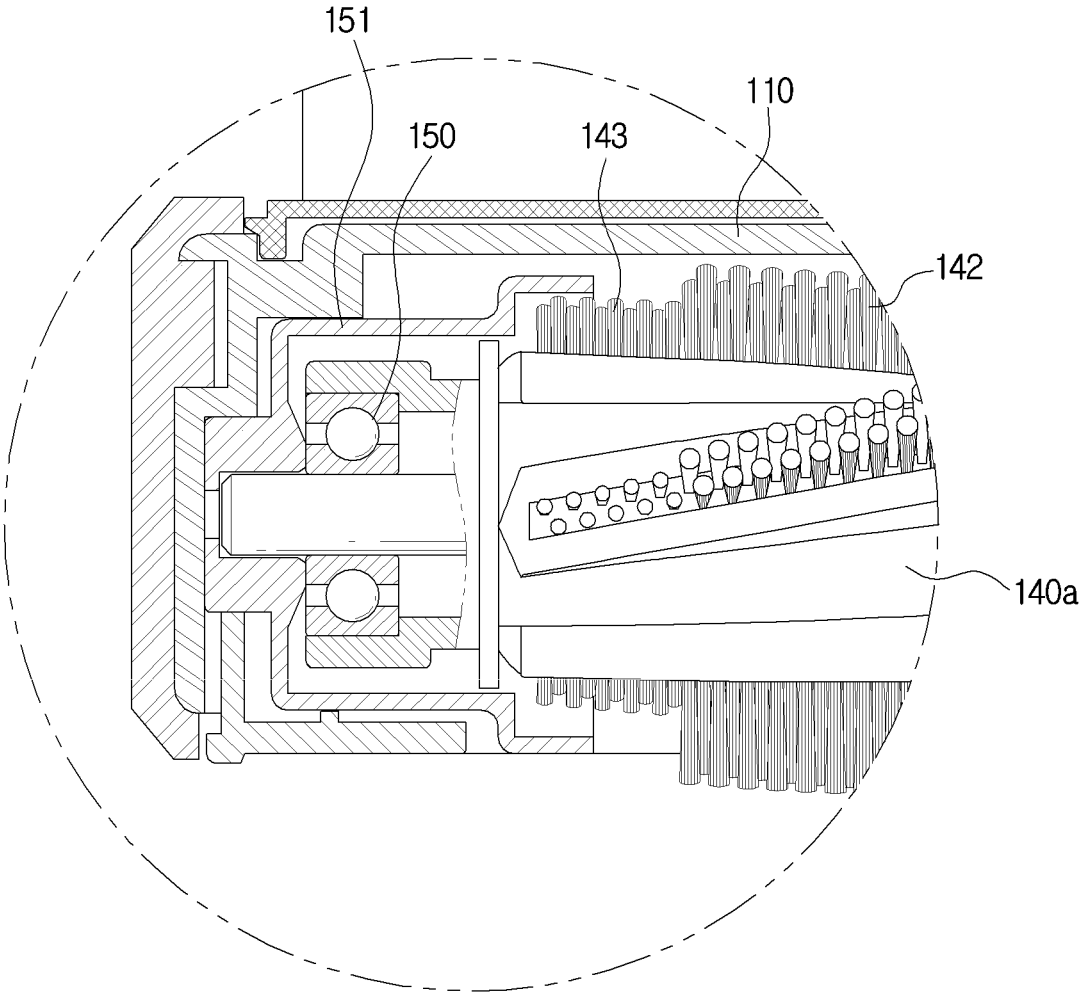
FIG. 14 is a sectional view illustrating a part of the drum brush unit of the embodiment of the present disclosure shown in FIG. 13.

FIG. 13 is a view illustrating a drum brush, a rotating drum bearing, and a rotating drum cover in a vacuum cleaner according to another embodiment of the present disclosure. FIG. 14 is a sectional view illustrating a part of the drum brush unit of the embodiment of the present disclosure shown in FIG. 13.

The drum brush unit 100 according to the present embodiment may include the drum brush 140 accommodated in the housing 110, a rotating drum bearing 150, and a rotating drum cover 151.

The rotating drum bearing 150 may be coupled to one end of the drum brush 140. The rotating drum bearing 150 may be coupled to the rotary shafts 141*a* and 141*b* of the drum brush 140. The rotating drum bearing 150 may include a hollow space. The rotary shafts 141*a* and 141*b* may be fitted in the hollow space of the rotating drum bearing 150.

The rotating drum cover 151 may cover one end of the drum brush 140. The rotating drum cover 151 may be provided to surround part of the drum brush 140 where the brush 142 is located. When the drum brush 140 rotates, the brush 142 may rotate in contact with an inner wall of the rotating drum cover 151. With this structure, it is possible to prevent foreign matter from entering between the brush 142 and the rotating drum cover 151.

Although the brush 142 is described as being in contact with the inner wall of the rotating drum cover 151, the brush 142 may not be in contact with the inner wall of the rotating drum cover 151. A distance between an end of the brush 142 and the inner wall of the rotating drum cover 151 may need to be small to prevent foreign matter from entering between the brush 142 and the rotating drum cover 151.

The rotating drum bearing 150 and the rotating drum cover 151 may replace the blocking ribs 113. The drum brush 140 may be provided with the blocking rib 113 at one end thereof and the rotating drum bearing 150 and the rotating drum cover 151 may be provided at the other end of the drum brush 140. Alternatively, the rotating drum bearing 150 and the rotating drum cover 151 may be provided at both ends or one end of the drum brush 140.

Figure 15:
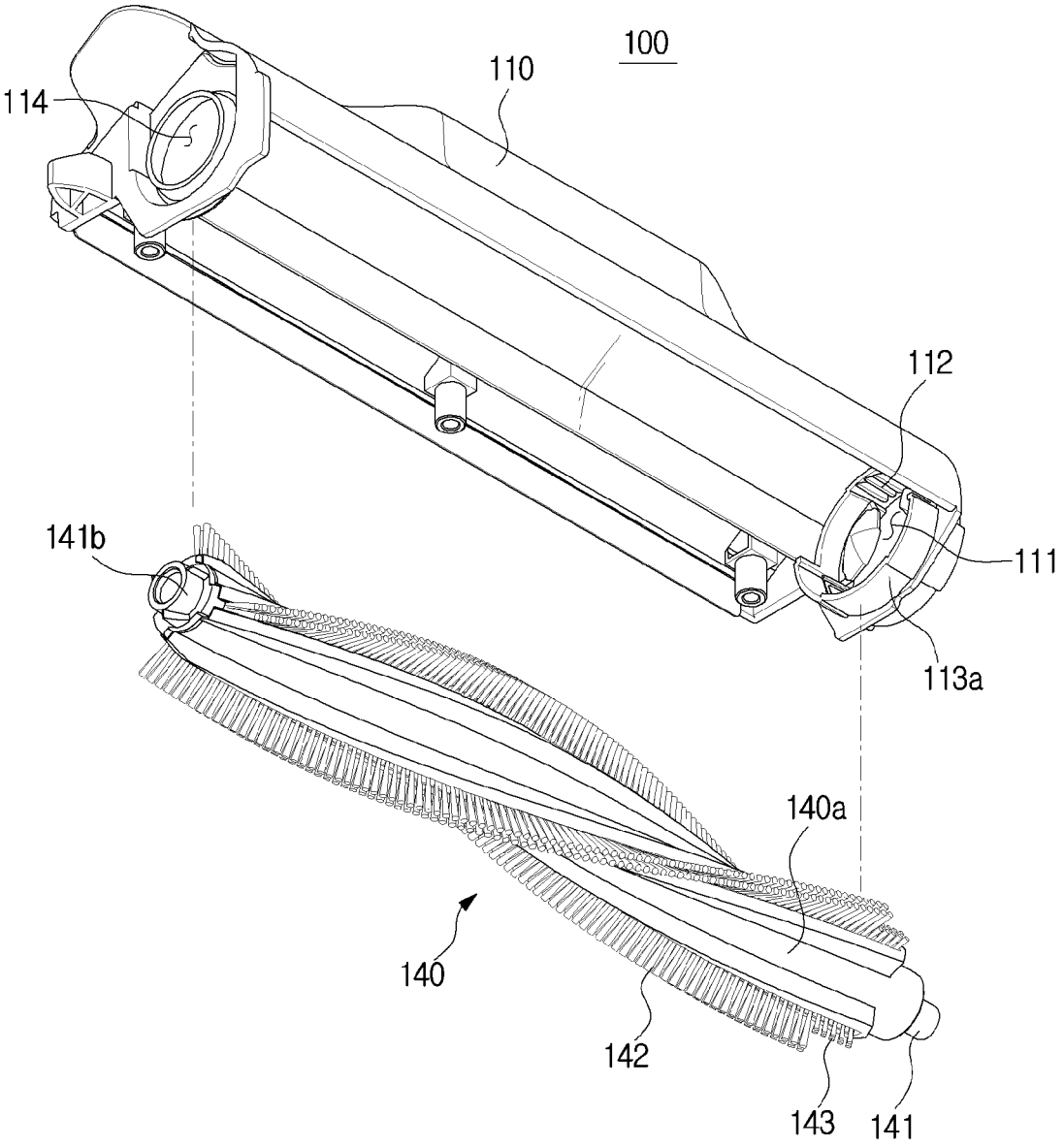
FIG. 15 is an exploded perspective view illustrating a drum brush unit according to another embodiment of the present disclosure.
Figure 16:
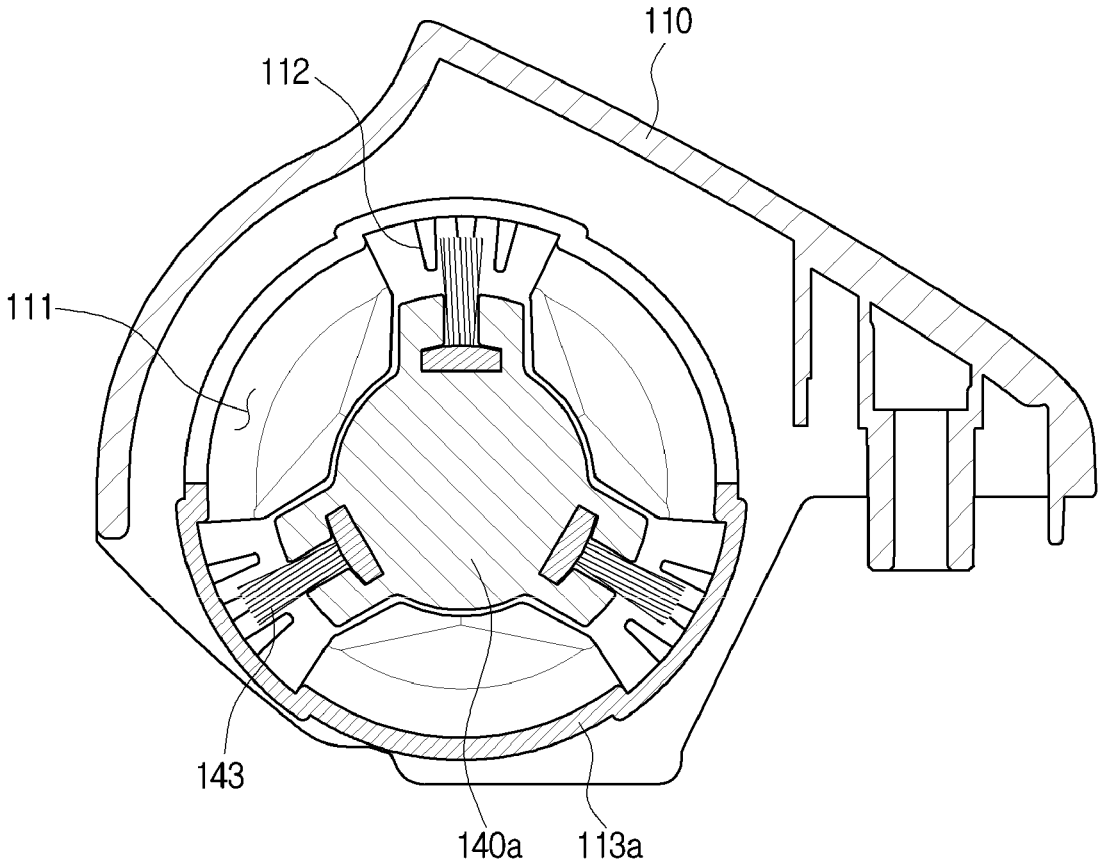
FIG. 16 is a sectional view illustrating the drum brush unit shown in FIG. 15.

FIG. 15 is an exploded perspective view illustrating a drum brush unit according to another embodiment of the present disclosure. FIG. 16 is a sectional view illustrating the drum brush unit shown in FIG. 15.

According to the present embodiment, a blocking rib 113*a* may be provided in an arc or a semicircular shape.

According to the embodiment shown in FIG. 6, the blocking rib 113 may be provided in an annular shape. However, according to the present embodiment, the blocking rib 113*a* may be provided in an arc or a semicircular shape.

In FIGS. 15 and 16, the blocking rib 113*a* having a semicircular shape is shown, but in the alternative, the blocking rib may be provided in an arc shape.

At this time, the blocking rib 113*a* may be provided on an outer lower side of the mounting hole 111. That is, the portion where the blocking rib 113*a* is not provided may be disposed above the mounting hole 111. Accordingly, the blocking rib 113*a* may prevent foreign matter on the surface from moving toward the rotary shaft side through the mounting hole 111.

Figure 17:
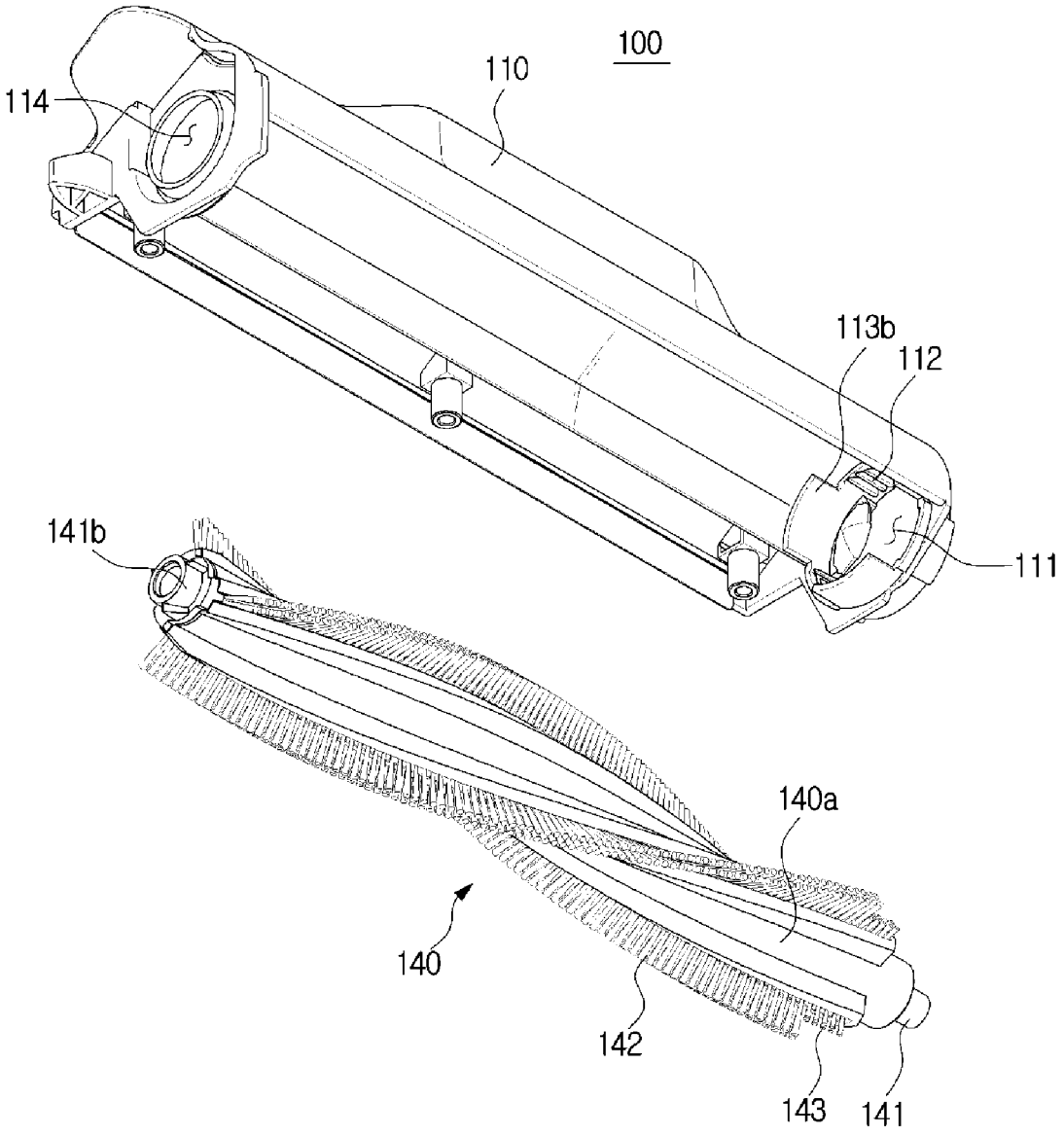
FIG. 17 is an exploded perspective view illustrating a drum brush unit according to another embodiment of the present disclosure.
Figure 18:
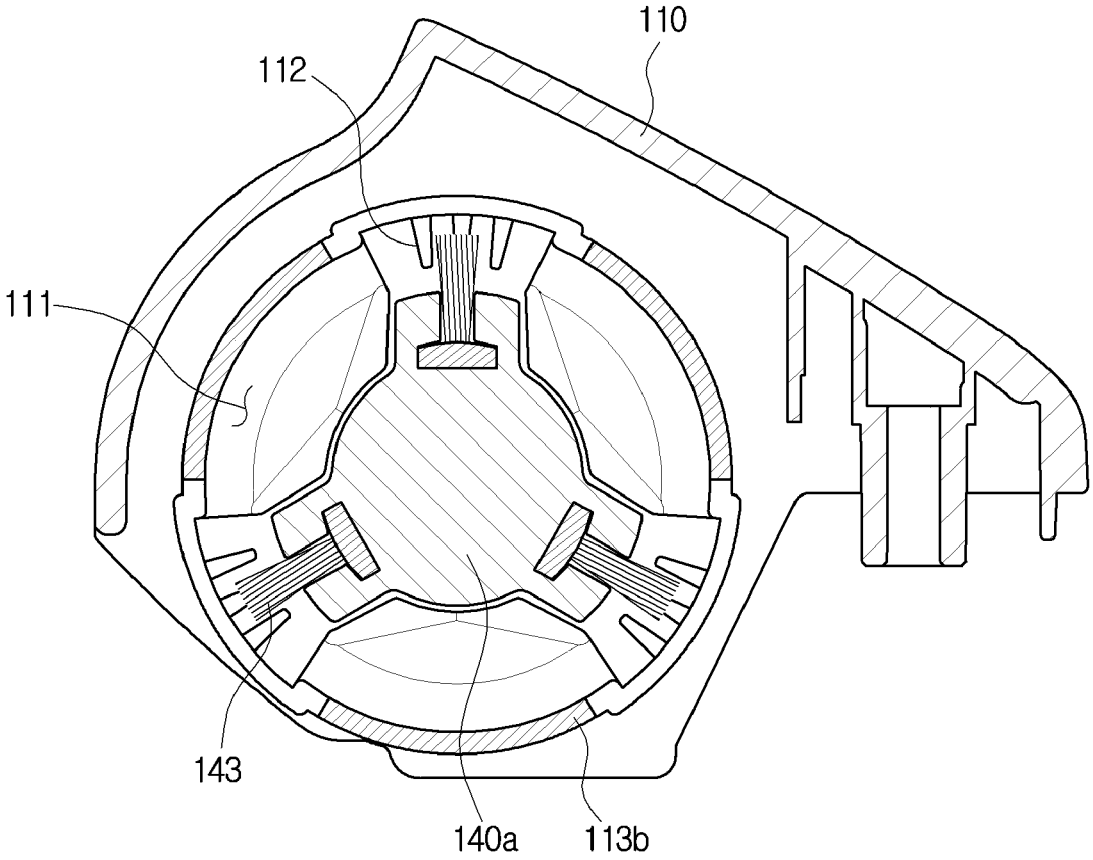
FIG. 18 is a sectional view illustrating the drum brush unit shown in FIG. 17.

FIG. 17 is an exploded perspective view illustrating a drum brush unit according to another embodiment of the present disclosure. FIG. 18 is a sectional view illustrating the drum brush unit shown in FIG. 17.

According to the present embodiment, a blocking rib 113*b* may be composed of a plurality of divided arcs.

As shown in FIGS. 17 and 18, the blocking ribs 113*b* may be composed of a plurality of arcs spaced along the circumference of the mounting hole 111. FIGS. 17 and 18 illustrate an embodiment composed of three arcs spaced along the circumference of the mounting hole 111, but the present disclosure is not limited thereto. The blocking ribs may be comprised of two or more arcs. However, at least one of the plurality of arcs constituting the blocking rib needs to be provided on the lower side of the mounting hole 111. Accordingly, the blocking ribs 113*b* may prevent foreign matter on the surface from moving toward the rotary shaft side through the mounting hole 111.

Figure 19:
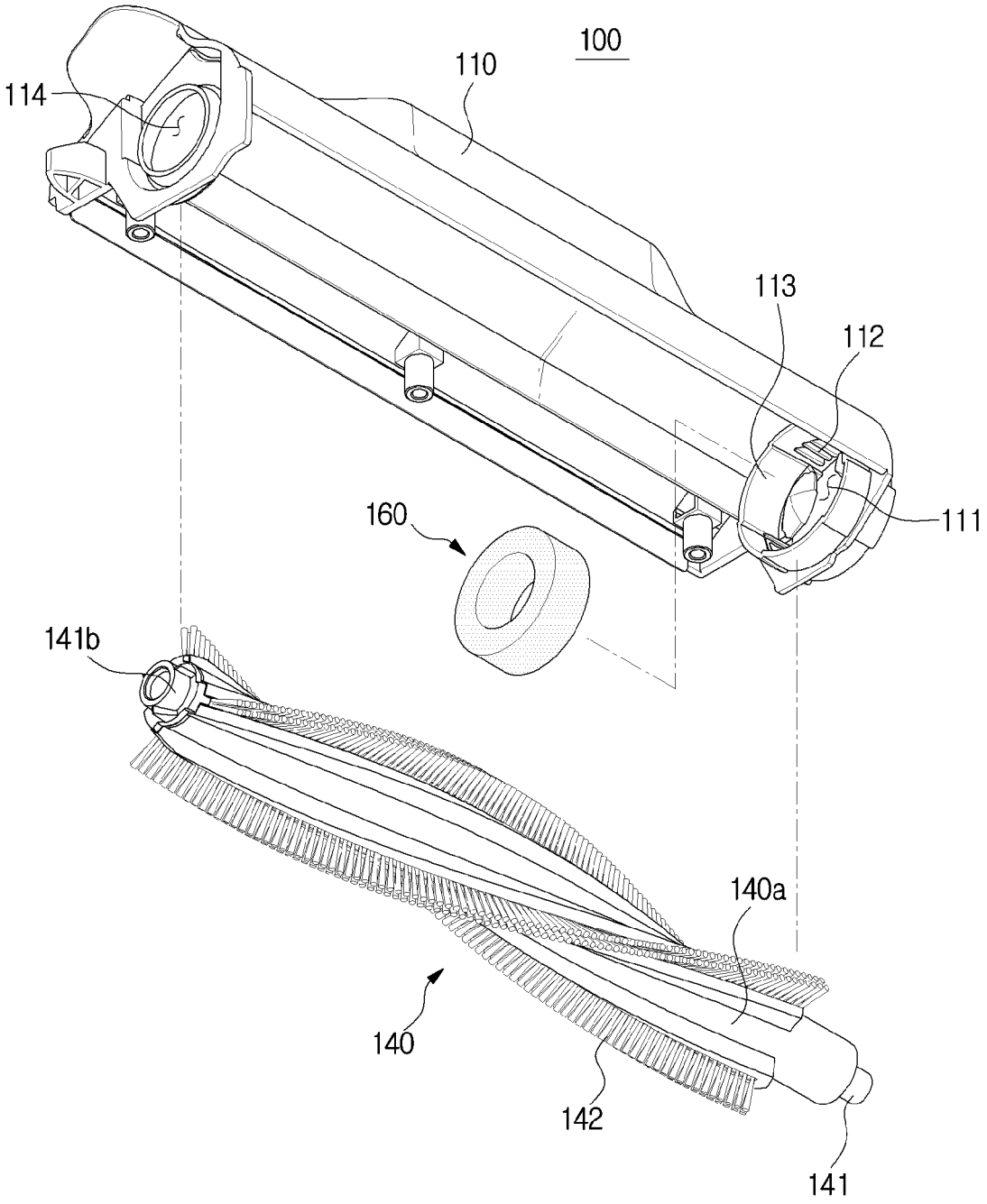
FIG. 19 is an exploded perspective view illustrating a drum brush unit according to another embodiment of the present disclosure.
Figure 20:
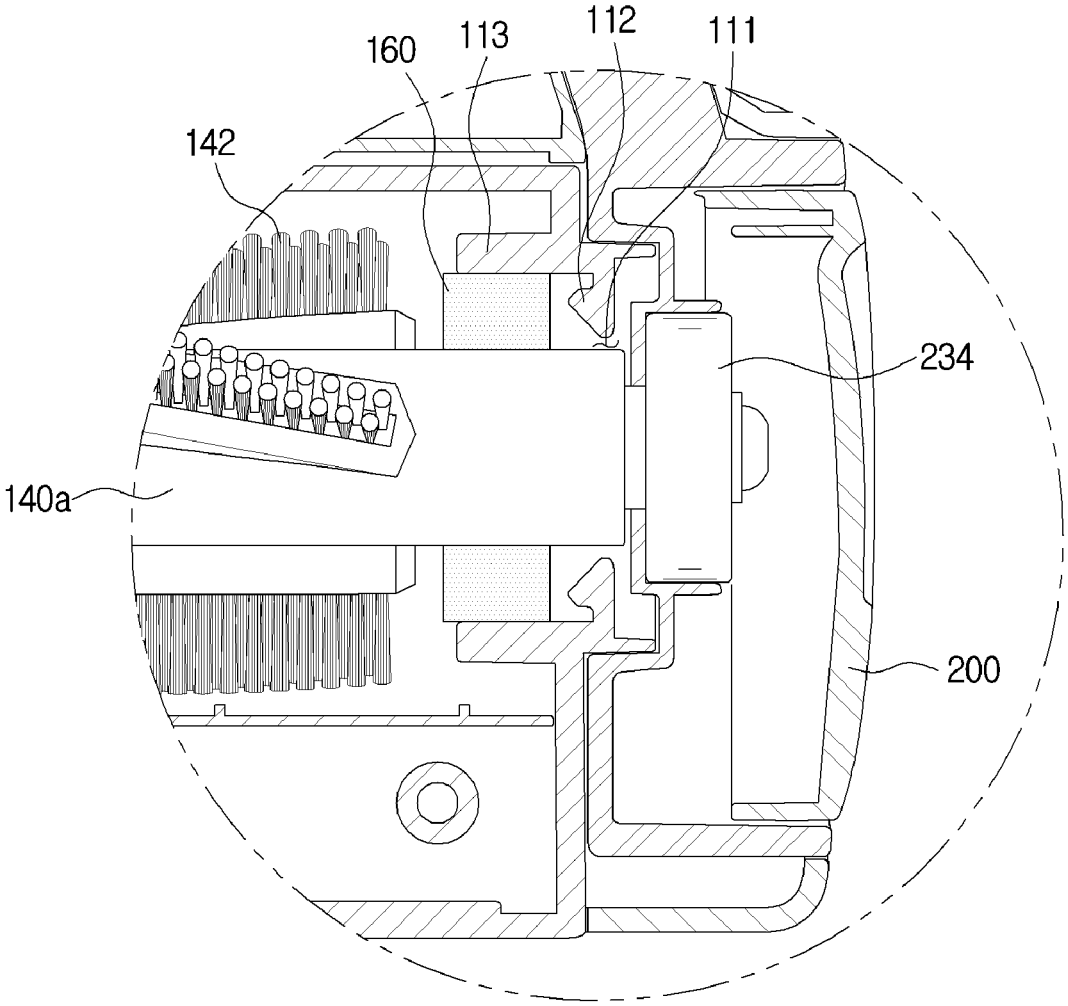
FIG. 20 is a sectional view illustrating a part of the drum brush unit shown in FIG. 19.

FIG. 19 is an exploded perspective view illustrating a drum brush unit according to another embodiment of the present disclosure. FIG. 20 is a sectional view illustrating a part of the drum brush unit shown in FIG. 19.

According to the present embodiment, the drum brush unit 100 may include a sealing member 160 made of wool or heat-resistant foam.

The sealing member 160 may be coupled to the blocking rib 113. More specifically, the sealing member 160 may be fitted to the blocking rib 113. When the sealing member 160 is coupled to the blocking rib 113, the sealing member 160 may be fixed to the housing 110.

As shown in FIG. 18, one end of the drum brush 140 may be coupled to the housing 110 through the sealing member 160 and the mounting hole 111 after the sealing member 160 is coupled to the blocking rib 113.

The sealing member 160 may seal the space between the blocking rib 113 and the drum brush 140. This blocking structure may prevent foreign matter from flowing into the space between the blocking rib 113 and the drum brush 140.

When the drum brush 140 rotates, the sealing member 160 may be fixed to the blocking rib 113 and may not rotate. The drum brush 140 and the sealing member 160 may rotate relative to each other. When the drum brush 140 rotates at a high speed, heat may be generated due to friction with the sealing member 160. As described above, since the sealing member 160 may be formed of wool or heat-resistant foam, the drum brush 140 may not be deformed or burned even if heat is generated due to the rotation of the drum brush 140.

Figure 21:
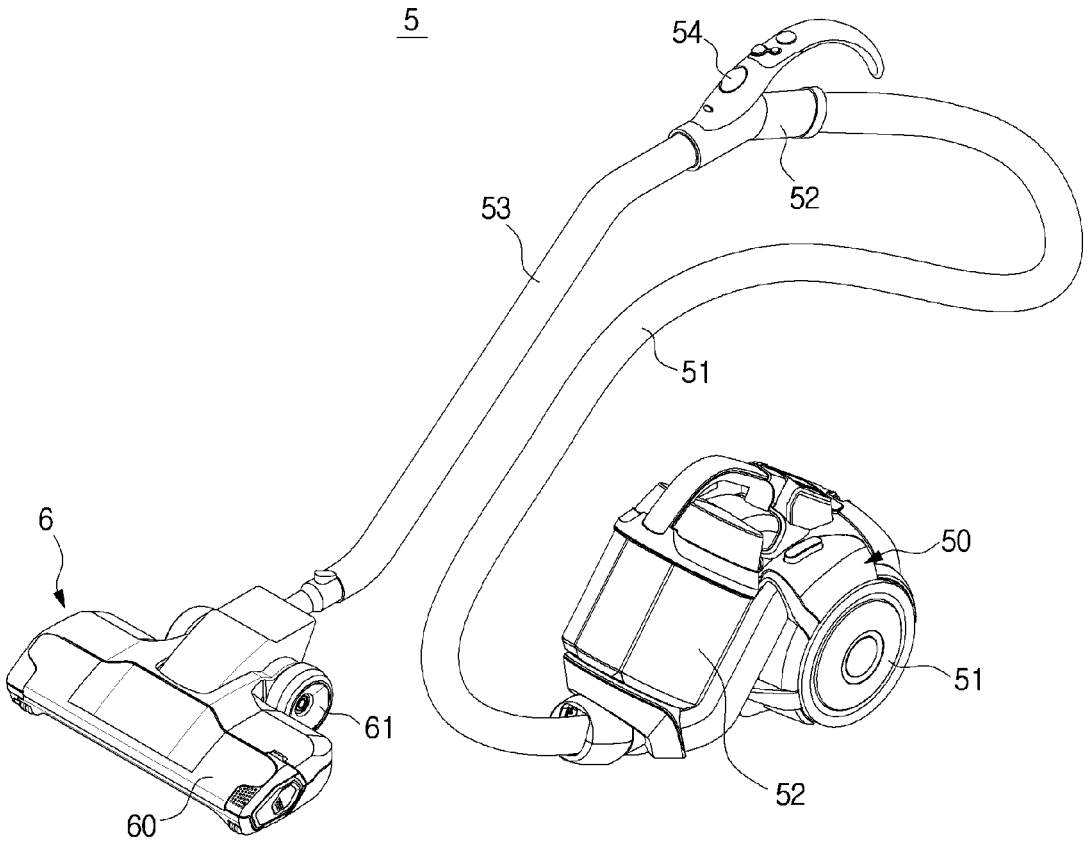
FIG. 21 is a perspective view illustrating a vacuum cleaner according to another embodiment of the present disclosure.

FIG. 21 is a perspective view illustrating a vacuum cleaner according to another embodiment of the present disclosure.

Referring to FIG. 21, a drum brush unit 60 having the foreign matter blocking structure may also be applied to a canister-type vacuum cleaner 5. The canister-type vacuum cleaner 5 includes a main body 50 provided with a fan motor. The main body 50 may be provided with a wheel 51 for moving and a dust collector 52 for separating and collecting foreign matter in the sucked air.

A suction portion 6 may suck air and foreign matter. An extension pipe 53 made of resin or metal, a handle pipe 52 for the user's operation, and a flexible hose 51 made of a flexible material for free movement of the handle pipe 52 may be provided between the main body 50 and the suction portion 6. The handle pipe 52 may be provided with an operating portion 54 capable of operating functions of the canister-type vacuum cleaner 5. The suction portion 6 may be connected to the extension pipe 53.

The suction portion 6 may be provided with a wheel 61 for easy movement of the suction portion 6. The suction portion 6 may be provided with the drum brush unit 60 detachably mounted thereon. The configuration of the drum brush unit 60 may be similarly applied to the configuration of the drum brush unit shown in FIGS. 4 to 19. A structure capable of blocking a movement of foreign matter moving in a direction of the rotary shaft of the drum brush in the drum brush unit may be embodied as a blocking rib provided on the housing and a brush provided on one side of the drum brush and rotating in contact with an inner surface of the blocking rib. The shape of the brush provided on the outer surface of the rotating drum is not limited to that described above.

The invention claimed is:

1. A vacuum cleaner comprising:

a suction portion having a suction port through which air and foreign matter are sucked, wherein the suction portion comprises a housing and a drum brush rotatably provided in the housing, wherein the drum brush comprises a rotating drum rotated by receiving a driving force and a brush mounted on the rotating drum, the brush having a first brush portion and a second brush portion having a diameter less than the first brush portion, and wherein the housing is provided with an annular blocking rib, and the second brush portion is located at one end of the drum brush and is configured such that at least a part of the second brush portion is accommodated within the annular blocking rib.

2. The vacuum cleaner according to claim 1, wherein the part of the second brush portion accommodated within the annular blocking rib is configured to contact an inner wall of the annular blocking rib.

3. The vacuum cleaner according to claim 1, wherein the first brush portion is configured to pick up foreign matter and the second brush portion is shorter than the first brush portion.

4. The vacuum cleaner according to claim 3, wherein the brush extends spirally along a longitudinal direction of the rotating drum.

5. The vacuum cleaner according to claim 4, wherein the second brush portion is configured to surround a part of an outer surface of one end of the rotating drum.

6. The vacuum cleaner according to claim 1, wherein the suction portion includes a driving source, and the driving source is connected to the other end of the drum brush to provide a driving force to the drum brush.

7. The vacuum cleaner according to claim 1, wherein a connecting member to which one end of the drum brush unit is connected is mounted on the housing.

8. The vacuum cleaner according to claim 7, wherein a mounting hole is provided on one side of the housing, and the connecting member and the drum brush are connected through the mounting hole.

9. The vacuum cleaner according to claim 8, wherein the connecting member is detachably mounted on the housing together with the drum brush.

10. The vacuum cleaner according to claim 9, wherein the drum brush is detached from the housing or mounted on the housing by passing through the mounting hole.

11. The vacuum cleaner according to claim 10, wherein a remover protrusion protruding inward is provided on an outer circumferential surface of the mounting hole, and when the drum brush unit passes through the mounting hole, foreign matter attached to the outer circumferential surface of the drum brush is separated by the remover protrusion.

12. The vacuum cleaner according to claim 1, wherein the suction portion is provided with a wheel for movement.

13. The vacuum cleaner according to claim 1, further comprising a main body connected to the suction portion, and a frame on which the main body and the suction portion are mounted.

14. The vacuum cleaner according to claim 13, wherein the main body is configured to be detachably mounted on the frame.

15. The vacuum cleaner according to claim 14, wherein the main body is configured to be detachable from the frame to operate as a separate vacuum cleaner.

* * * * *